US009440114B2

(12) United States Patent
Ortwig

(10) Patent No.: US 9,440,114 B2
(45) Date of Patent: Sep. 13, 2016

(54) BOOT SOLE SYSTEM AND FIN FOR SAME

(71) Applicant: Cetatek Holdings Inc., Vancouver (CA)

(72) Inventor: Jan Peter Ortwig, Bowen Island (CA)

(73) Assignee: Cetatek Holdings Inc., North Vancouver (CA)

( * ) Notice: Subject to any disclaimer, the term of this patent is extended or adjusted under 35 U.S.C. 154(b) by 0 days.

(21) Appl. No.: 14/435,084

(22) PCT Filed: Oct. 12, 2012

(86) PCT No.: PCT/CA2012/000946
§ 371 (c)(1),
(2) Date: Apr. 10, 2015

(87) PCT Pub. No.: WO2014/056066
PCT Pub. Date: Apr. 17, 2014

(65) Prior Publication Data

US 2015/0231449 A1 Aug. 20, 2015

(51) Int. Cl.
*A63B 31/11* (2006.01)
*A43B 5/08* (2006.01)
*A43B 13/14* (2006.01)

(52) U.S. Cl.
CPC ..... *A63B 31/11* (2013.01); *A43B 5/08* (2013.01); *A43B 13/14* (2013.01); *A63B 2031/112* (2013.01)

(58) Field of Classification Search
CPC A63B 31/11; A63B 2031/112; A63B 31/14; A63B 69/06; A43B 5/08; B63H 16/00; B63H 16/04; B63H 16/08; B63H 16/18; B63H 2016/00; B63H 2016/04; B63H 2016/08; B63H 2016/18
USPC ..... 441/55, 60–64, 70
See application file for complete search history.

(56) References Cited

U.S. PATENT DOCUMENTS 1,607,857 A 5/1926 Zukal
3,171,142 A 3/1965 Auzols
(Continued)

FOREIGN PATENT DOCUMENTS

CN 201220068 Y 4/2009
DE 55619 C 3/1891
(Continued)

OTHER PUBLICATIONS

"Aqua Lung Slingshot," Product Information, Aqua Lung International, Vista, Calif., as early as Feb. 14, 2008, <http://aqualung.com/us/content/view/226/282> [retrieved Jul. 12, 2013], 1 page.
(Continued)

*Primary Examiner* — Daniel V Venne
(74) *Attorney, Agent, or Firm* — Christensen O'Connor Johnson Kindness PLLC

(57) ABSTRACT

In one illustrative embodiment, there is provided a boot sole system for guiding a fin, the system comprising: at least one toe sole body connectable to the fin and comprising first and second stop surfaces; a posterior sole body comprising third and fourth stop surfaces; and a transverse hinge for hingedly connecting the at least one toe sole body to the posterior sole body to permit longitudinal deflection of the at least one toe sole body relative to the posterior sole body in a first deflection direction and in a second deflection direction opposite the first deflection direction. The first, second, third, and fourth stop surfaces are positioned to restrict longitudinal deflection of the at least one toe sole body relative to the posterior sole body in the first deflection direction and in the second deflection direction. Fins are also disclosed.

26 Claims, 23 Drawing Sheets

(56) References Cited

U.S. PATENT DOCUMENTS

| | | | | |
|---|---|---|---|---|
| 3,183,529 | A | 5/1965 | Beuchat | |
| 3,302,223 | A | 2/1967 | Ciccotelli | |
| 3,315,286 | A | 4/1967 | Brion | |
| 3,422,470 | A | 1/1969 | Mares | |
| 3,922,741 | A | 12/1975 | Semeia | |
| 3,978,537 | A | 9/1976 | Shamlian | |
| 4,025,977 | A | 5/1977 | Cronin | |
| D266,265 | S | 9/1982 | Bowden | |
| 4,538,480 | A | 9/1985 | Trindle | |
| 4,642,056 | A | 2/1987 | Keivanjah | |
| 4,657,515 | A | 4/1987 | Ciccotelli | |
| 4,677,769 | A | 7/1987 | Ahmad | |
| 4,689,029 | A | 8/1987 | Ciccotelli | |
| 4,738,645 | A | 4/1988 | Garofalo | |
| 4,775,343 | A | 10/1988 | Lamont | |
| 4,807,372 | A | 2/1989 | McCall | |
| 4,869,696 | A | 9/1989 | Ciccotelli | |
| 4,887,985 | A | 12/1989 | Garofalo | |
| 5,041,039 | A * | 8/1991 | Chang | A63B 31/11 36/8.1 |
| 5,163,859 | A | 11/1992 | Beltrani | |
| 5,242,321 | A | 9/1993 | Gil | |
| 5,292,272 | A | 3/1994 | Grim | |
| 5,295,701 | A | 3/1994 | Reiber | |
| 5,303,940 | A | 4/1994 | Brandner | |
| 5,304,081 | A | 4/1994 | Takizawa | |
| 5,324,219 | A | 6/1994 | Beltrani | |
| 5,331,752 | A | 7/1994 | Johnson | |
| D355,012 | S | 1/1995 | Robertson | |
| 5,401,196 | A | 3/1995 | Triantafyllou | |
| 5,443,593 | A | 8/1995 | Garofalo | |
| 5,447,457 | A | 9/1995 | Kamitani | |
| 5,452,907 | A | 9/1995 | Meibock | |
| 5,507,506 | A | 4/1996 | Shadroui | |
| 5,545,067 | A | 8/1996 | Garofalo | |
| 5,551,728 | A | 9/1996 | Barthel | |
| 5,572,806 | A | 11/1996 | Osawa | |
| 5,588,890 | A | 12/1996 | Garofalo | |
| 5,593,333 | A * | 1/1997 | Johnson | A63B 31/14 441/62 |
| 5,607,334 | A | 3/1997 | Garofalo | |
| 5,630,775 | A | 5/1997 | Raasch | |
| 5,632,662 | A | 5/1997 | Cadorette | |
| 5,683,279 | A | 11/1997 | Raasch | |
| 5,716,250 | A | 2/1998 | Garofalo | |
| 5,722,867 | A | 3/1998 | LaGrow | |
| 5,746,016 | A | 5/1998 | Freisinger | |
| 5,746,631 | A | 5/1998 | McCarthy | |
| 5,766,050 | A | 6/1998 | Maggi | |
| 5,797,608 | A | 8/1998 | Haldemann | |
| 5,813,889 | A | 9/1998 | Perry | |
| 5,879,212 | A * | 3/1999 | Kennedy | A63B 31/11 441/64 |
| 5,941,747 | A | 8/1999 | Garofalo | |
| 6,053,788 | A | 4/2000 | Garofalo | |
| 6,120,038 | A | 9/2000 | Dong | |
| 6,120,336 | A | 9/2000 | Kawai | |
| 6,126,502 | A | 10/2000 | Hull | |
| 6,126,503 | A | 10/2000 | Viale | |
| 6,129,601 | A | 10/2000 | Aucoin | |
| 6,146,224 | A | 11/2000 | McCarthy | |
| 6,179,675 | B1 | 1/2001 | Godoy | |
| 6,227,923 | B1 * | 5/2001 | Johnson | A63B 31/11 441/61 |
| 6,290,561 | B1 | 9/2001 | Garofalo | |
| 6,322,411 | B1 | 11/2001 | Evans | |
| 6,322,412 | B2 | 11/2001 | Viale | |
| 6,364,728 | B1 | 4/2002 | Viale | |
| 6,540,574 | B2 | 4/2003 | Hashizume | |
| 6,568,973 | B2 | 5/2003 | Testa | |
| 6,568,974 | B2 | 5/2003 | Semeia | |
| 6,568,975 | B1 | 5/2003 | Perry | |
| 6,672,920 | B2 | 1/2004 | Wilson | |
| 6,719,599 | B2 | 4/2004 | McCarthy | |
| 6,758,708 | B2 | 7/2004 | Angelini | |
| 6,814,640 | B1 | 11/2004 | Houck | |
| 6,843,693 | B2 | 1/2005 | McCarthy | |
| 6,884,134 | B2 | 4/2005 | McCarthy | |
| 7,007,626 | B2 | 3/2006 | Hobson | |
| 7,048,601 | B2 * | 5/2006 | Sclafani | A63B 31/11 441/64 |
| 7,086,916 | B2 | 8/2006 | Godoy | |
| 7,115,011 | B2 | 10/2006 | Chen | |
| 7,124,476 | B2 | 10/2006 | Garofalo | |
| 7,134,927 | B1 | 11/2006 | Johnson | |
| 7,140,937 | B2 | 11/2006 | Cadorette | |
| 7,159,336 | B2 | 1/2007 | Burns | |
| 7,172,480 | B2 | 2/2007 | Abbott | |
| D561,862 | S | 2/2008 | Moyal | |
| D561,863 | S | 2/2008 | Moyal | |
| 7,462,085 | B2 | 12/2008 | Moyal | |
| 7,470,164 | B2 | 12/2008 | Moyal | |
| 7,601,041 | B2 | 10/2009 | McCarthy | |
| 7,815,477 | B2 | 10/2010 | Garofalo | |
| 7,988,510 | B2 | 8/2011 | Beltrani | |
| 8,087,959 | B2 | 1/2012 | Hsu | |
| 8,376,796 | B1 * | 2/2013 | Vock | A63B 31/11 441/64 |
| 8,641,464 | B2 | 2/2014 | Ortwig | |
| 2007/0004295 | A1 | 1/2007 | Rocci | |
| 2007/0032144 | A1 | 2/2007 | Ketterman | |
| 2007/0077831 | A1 | 4/2007 | Kuo | |
| 2008/0185816 | A1 | 8/2008 | Riepler | |
| 2010/0029153 | A1 | 2/2010 | Testa | |
| 2010/0075554 | A1 | 3/2010 | Johnson | |
| 2011/0312231 | A1 | 12/2011 | Montemurro | |
| 2014/0206247 | A1 | 7/2014 | Ortwig | |

FOREIGN PATENT DOCUMENTS

| | | | |
|---|---|---|---|
| DE | 84 22 316.2 | U1 | 11/1984 |
| DE | 90 17 320.1 | U1 | 4/1991 |
| DE | 40 40 985 | C1 | 6/1992 |
| DE | 296 22 809 | U1 | 8/1997 |
| DE | 196 13 208 | A1 | 10/1997 |
| DE | 196 33 905 | A1 | 10/1997 |
| DE | 196 54 899 | A1 | 11/1997 |
| DE | 197 00 497 | A1 | 7/1998 |
| DE | 197 26 109 | A1 | 7/1998 |
| DE | 101 52 438 | A1 | 4/2003 |
| EP | 0 310 828 | B1 | 11/1991 |
| EP | 0 884 073 | A2 | 12/1998 |
| EP | 0 890 375 | A1 | 1/1999 |
| EP | 1 297 869 | A1 | 4/2003 |
| EP | 1 389 483 | B1 | 2/2004 |
| EP | 1 591 145 | A1 | 11/2005 |
| EP | 2 058 032 | A1 | 5/2009 |
| FR | 2 659 534 | A1 | 9/1991 |
| FR | 2 659 862 | A1 | 9/1991 |
| FR | 2 725 880 | A1 | 4/1996 |
| FR | 2 794 374 | A1 | 12/2000 |
| GB | 1 033 304 | A | 6/1966 |
| WO | 88/01523 | A1 | 3/1988 |
| WO | 91/16957 | A1 | 11/1991 |
| WO | 95/03101 | A1 | 2/1995 |
| WO | 97/36655 | A1 | 10/1997 |
| WO | 97/49603 | A1 | 12/1997 |
| WO | 98/30294 | A1 | 7/1998 |
| WO | 99/47013 | A1 | 9/1999 |
| WO | 00/78606 | A1 | 12/2000 |
| WO | 02/47776 | A2 | 6/2002 |
| WO | 2006/058849 | A1 | 6/2006 |
| WO | 2008/087589 | A1 | 7/2008 |
| WO | 2011/080432 | A1 | 7/2011 |
| WO | 2011/123950 | A1 | 10/2011 |
| WO | 2011/134066 | A1 | 11/2011 |
| WO | 2007/138367 | A1 | 12/2011 |
| WO | 2014/056066 | A1 | 4/2014 |

OTHER PUBLICATIONS

"Cressi Scuba Diving Fins," Product Information, Cressi Sub S.p. A., Genoa, Italy, as early as Apr. 5, 2011, <http://www.cressisubusa.

(56) References Cited

OTHER PUBLICATIONS com/catalogue /index.asp?CategoriaID=101020> [retrieved Jul. 12, 2013], 3 pages.
Extended European Search Report mailed Aug. 1, 2013, in related European Application No. 11 764 992.1, filed Apr. 7, 2011, 5 pages.
International Search Report mailed Jul. 12, 2013, issued in corresponding International Application No. PCT/CA2012/000946, filed Oct. 12, 2012, 2 pages.
"Lundblue: Lunocet—Pioneering Biomimetic Propulsion," Product Sheet, Ciamillo Components, Inc., Nicholson, Ga., <http://www.lunocet.com/> [retrieved Jan. 1, 2010], 1 page.
McKenzie, J., "Two Mares Fins: The Volo Power is Still Strong and the Next Gen X-Stream is High Tech," Jul. 28, 2011, ScubaGadget, Scuba News Service, <http://www.scubagadget.com/?p=1555> [retrieved Jan. 16, 2013], 4 pages.
"Omega Aquatics Amphibian Fins," Product Information, Soldier Systems: An Industry Daily, Jul. 11, 2008, <http://soldiersystems.net/2008/07/11/omega-aquatics-amphibian-fins/> [retrieved Jan. 17, 2013], 2 pages.
"Open Heel—Mares," Product Information, Mares S.p.A., Rapallo, Italy, <http://www.mores.com/products/fins/open-heel/?region=eu> [retrieved Jan. 16, 2013], 2 pages.
"Scuba Dive Fins," Product Information, Waikiki Dive Centre, Singapore, <http://www.waikikidive.com/TUSA_MARES_FINS.htm> [retrieved Jan. 16, 2013], 7 pages.
"TUSA Fins," Product Information,TUSA (Tabata USA), Tokyo, as early as Jul. 23, 2012, <http://tusa.com/us-en/Tusa/Fins> [retrieved Jul. 12, 2013], 1 page.
"X-Stream—Open Heel—Mares—Just Add Water," Product Sheet, Mares S.p.A., Rapallo, Italy, <http://www.mares.com/products/fins/open-heel/x-stream/241/?region=eu> [retrieved Nov. 21, 2012], 1 page.
International Preliminary Report on Patentability and Written Opinion dated Apr. 14, 2015, issued in corresponding International Application No. PCT/CA2012/000946, filed Oct. 12, 2012, 5 pages.
International Search Report mailed Mar. 11, 2016, issued in International Application No. PCT/CA2015/051278, filed Dec. 4, 2015, 4 pages.

* cited by examiner

BOOT SOLE SYSTEM AND FIN FOR SAME

BACKGROUND

1. Field

The invention relates generally to boot soles and fins for boot soles.

2. Related Art

A user can couple a known flipper to each foot of the user. These known flippers have fins, and when the user kicks in water, for example, the fins can facilitate generating propulsion in the water.

Many known flippers have foot pockets for receiving a foot of a user, but these foot pockets are generally integral to the fin and available only in a small number of standard sizes because, for example, manufacturing and distribution costs of entire flippers with a large variety of foot sizes and shapes would be prohibitive. Therefore, when a user selects a flipper, a user must also select a single foot pocket size of the flipper, often from among a small number of available sizes. Therefore, these foot pockets often do not comfortably fit a foot of a user, and space between the foot and an inside wall of the foot pocket can receive water, disadvantageously adding to drag of the flipper in water and limiting the control of the user over the flipper. Other known flippers include alternatives to foot pockets, but such known alternatives may still require a user to choose from small number of standard sizes because, for example, of potentially high manufacturing and distribution costs for a large variety of foot sizes.

SUMMARY

According to one illustrative embodiment, there is provided a boot sole system for guiding a fin, the system comprising: at least one toe sole body connectable to the fin and comprising first and second stop surfaces; a posterior sole body comprising third and fourth stop surfaces; and a transverse hinge for hingedly connecting the at least one toe sole body to the posterior sole body to permit longitudinal deflection of the at least one toe sole body relative to the posterior sole body in a first deflection direction and in a second deflection direction opposite the first deflection direction. The first, second, third, and fourth stop surfaces are positioned such that when the transverse hinge connects the at least one toe sole body to the posterior sole body: the first and third stop surfaces abut each other in response to longitudinal deflection of the at least one toe sole body relative to the posterior sole body in the first deflection direction to restrict longitudinal deflection of the at least one toe sole body relative to the posterior sole body in the first deflection direction; and the second and fourth stop surfaces abut each other in response to longitudinal deflection of the at least one toe sole body relative to the posterior sole body in the second deflection direction to restrict longitudinal deflection of the at least one toe sole body relative to the posterior sole body in the second deflection direction.

According to another illustrative embodiment, there is provided a fin comprising a toe sole body hingedly connectable to a posterior sole body of a boot, wherein the toe sole body comprises first and second stop surfaces, and wherein: the first stop surface is positioned to abut a third stop surface on the posterior sole body in response to longitudinal deflection of the toe sole body relative to the posterior sole body in a first deflection direction, when the toe sole body is connected to the posterior sole body, to restrict longitudinal deflection of the toe sole body relative to the posterior sole body in the first deflection direction; and the second stop surface is positioned to abut a fourth stop surface on the posterior sole body in response to longitudinal deflection of the toe sole body relative to the posterior sole body in a second deflection direction opposite the first deflection direction, when the toe sole body is connected to the posterior sole body, to restrict longitudinal deflection of the toe sole body relative to the posterior sole body in the second deflection direction.

Other aspects and features of the present invention will become apparent to those ordinarily skilled in the art upon review of the following description of specific embodiments of the invention in conjunction with the accompanying figures.

DETAILED DESCRIPTION

Figure 1:
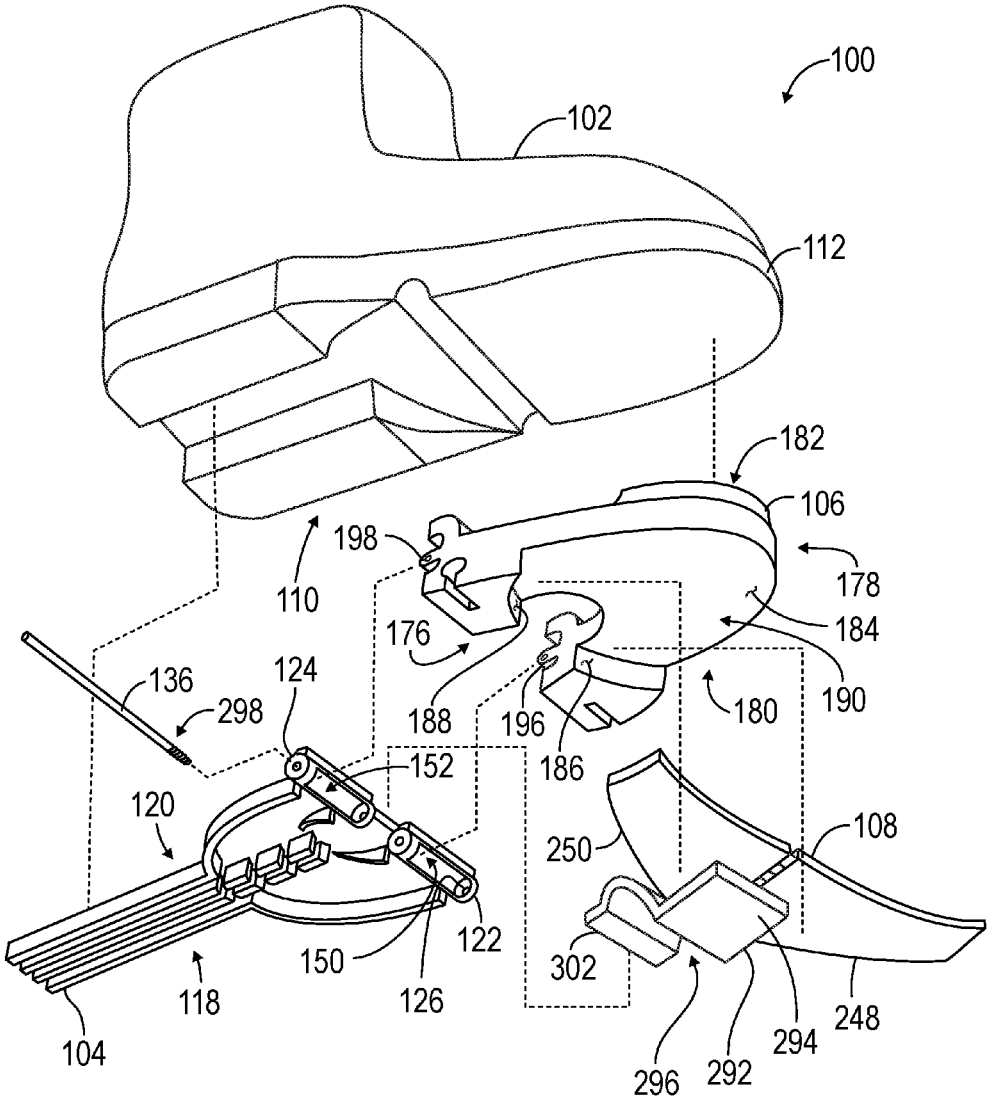
FIG. 1 is an exploded bottom perspective view of a boot system according to one illustrative embodiment.

Referring to FIG. 1, a boot system according to one illustrative embodiment is shown generally at 100. The boot system 100 includes a boot 102, a posterior sole body 104, a toe sole body 106, and a frame (or "Y-frame") 108.

When a user wearing the boot system 100 walks on a surface, a bottom side shown generally at 110 generally faces downward and therefore generally contacts the surface. In general, a "bottom" side herein refers to a side that faces downward and generally contacts a surface when a user walks on the surface. However, when swimming or diving in water, a user generally faces downward, and therefore a "bottom" side herein refers to a side that generally faces upward when in use during swimming or diving in water. A drawing of a "bottom view" herein generally refers to a view of such a "bottom" side, and therefore a "bottom view" herein generally refers to a view from above when in use in water.

The boot 102 includes a boot sole 112 on the bottom side 110 of the boot 102, and as described further below, the boot sole 112 in various embodiments may be bonded to the posterior sole body 104 and to the toe sole body 106 to form an integral boot sole including the posterior sole body 104 and the toe sole body 106.

Figure 2:
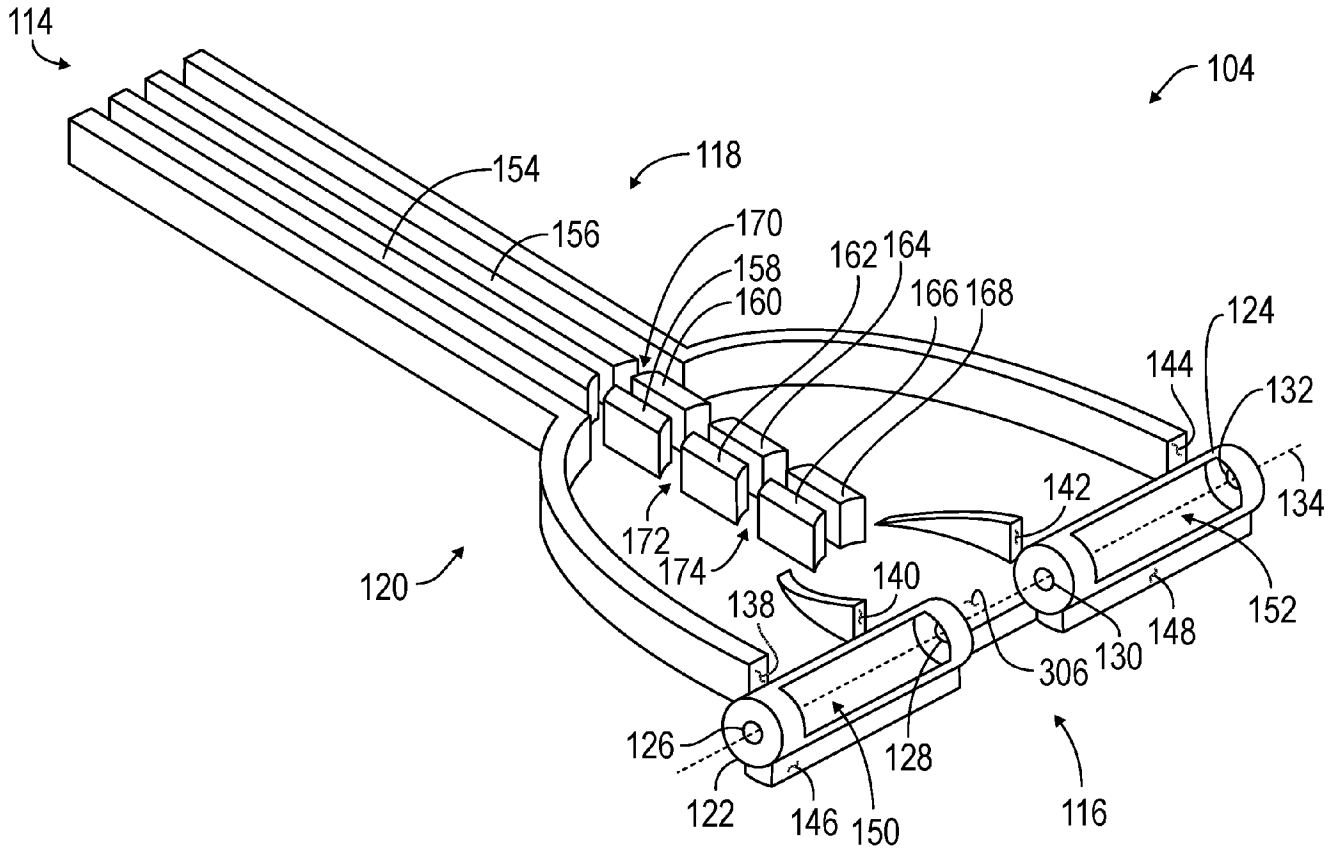
FIG. 2 is a bottom perspective view of a posterior sole body of the boot system of FIG. 1.

Referring to FIG. 2, the posterior sole body 104 extends between a heel end shown generally at 114 and a midsole end shown generally at 116 and opposite the heel end 114. The posterior sole body 104 also has a bottom side shown generally at 118 and a top side shown generally at 120. As indicated above, the bottom side 118 generally faces downward and generally contacts a surface when a user walks on the surface, but the bottom side 118 generally faces upward when in use during swimming or diving in water for example. The posterior sole body 104 is relatively rigid, and in various embodiments may include one of, or a combination of more than one of, carbon fibre, relatively rigid thermoplastic material, and metal. The posterior sole body 104 on the top side 120 may define a mesh grid pattern (not shown) to facilitate adhesion to and bonding with the bottom side 110 of the boot sole 112 (shown in FIG. 1).

At the midsole end 116, the posterior sole body 104 includes generally cylindrical pivot holders 122 and 124. The pivot holder 122 defines axial through-openings 126 and 128 and the pivot holder 124 defines axial through-openings 130 and 132. The through-openings 126, 128, 130, and 132 are sized and aligned along a generally transverse axis 134 to receive a pivot 136 (shown in FIG. 1) along the generally transverse axis 134. Also at the midsole end 116, the posterior sole body 104 defines stop surfaces 138, 140, 142, and 144 on the bottom side 118 and stop surfaces 146 and 148 on the top side 120. The stop surfaces 138, 140, 142, and 144 are generally coplanar in a plane extending from the generally transverse axis 134 towards the bottom side 118, and the stop surfaces 146 and 148 are generally coplanar in a plane extending from the generally transverse axis 134 towards the top side 120.

The pivot holder 122 defines an opening shown generally at 150 at the midsole end 116, and the pivot holder 124 defines an opening shown generally at 152 at the midsole end 116. The openings 150 and 152 may receive respective projections on the toe sole body 106 (shown in FIG. 1) for hingedly connecting the toe sole body 106 to the posterior sole body 104 as described further below.

The posterior sole body 104 includes projections 154, 156, 158, 160, 162, 164, 166, and 168 projecting towards the bottom side 118, with a generally transverse gap 170 between the projections 154, 156, 158, and 160, a generally transverse gap 172 between the projections 158, 160, 162, and 164, and a generally transverse gap 174 between the projections 162, 164, 166, and 168. The generally transverse gaps 170, 172, and 174 are spaced apart from each other longitudinally, namely in a direction extending from the heel end 114 to the midsole end 116.

Figure 3:
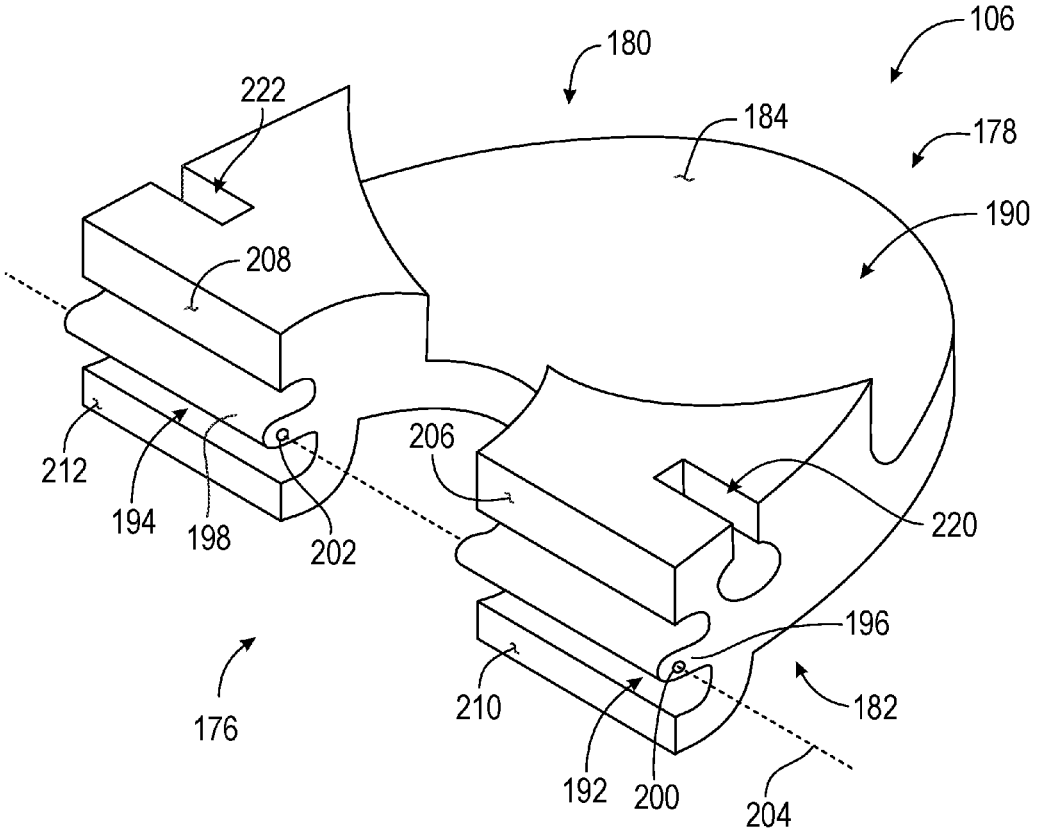
FIG. 3 is a bottom perspective view of a toe sole body of the boot system of FIG. 1.

Referring to FIG. 3, the toe sole body 106 extends between a midsole end shown generally at 176 and a toe end shown generally at 178 and opposite the midsole end 176. The toe sole body 106 also has a bottom side shown generally at 180 and a top side shown generally at 182. As indicated above, the bottom side 180 generally faces downward and generally contacts a surface when a user walks on the surface, but the bottom side 180 generally faces upward when in use during swimming or diving in water for example. The toe sole body 106 is relatively rigid, and in various embodiments may include one of, or a combination of more than one of, carbon fibre, relatively rigid thermoplastic material, and metal. The toe sole body 106 on the top side 182 may define a mesh grid pattern (not shown) to facilitate adhesion to and bonding with the bottom side 110 of the boot sole 112 (shown in FIG. 1).

On the bottom side 180 and towards the toe end 178, the toe sole body 106 defines a generally planar abutment surface 184 and generally curved abutment surfaces 186 and 188 (shown in FIG. 1) extending away from the generally planar abutment surface 184 towards the bottom side 180. The abutment surfaces 184, 186, and 188 abut corresponding surfaces of the frame 108 and define a receptacle shown generally at 190 for receiving a portion of the frame 108 as described further below.

Facing the midsole end 176, the toe sole body 106 defines a generally semi-cylindrical recess shown generally at 192 and a generally semi-cylindrical recess shown generally at 194. A projection 196 projects into the recess 192 towards the midsole end 176, and a projection 198 projects into the recess 194 towards the midsole end 176. The projection 196 defines a transverse through-opening 200, and the projection 198 defines a transverse through-opening 202. The through-openings 200 and 202 are aligned along a generally transverse axis 204 and are sized to receive the pivot 136 (shown in FIG. 1). Also at the midsole end 176, the toe sole body 106 defines stop surfaces 206 and 208 on the bottom side 180 and stop surfaces 210 and 212 on the top side 182. The stop surfaces 206 and 208 are generally coplanar in a plane extending from the generally transverse axis 204 towards the bottom side 180, and the stop surfaces 210 and 212 are generally coplanar in a plane extending from the generally transverse axis 204 towards the top side 182.

Referring to FIGS. 1, 2, and 3, the recesses 192 and 194 are sized to receive respective portions of the pivot holders 122 and 124 respectively, and the projections 196 and 198 are sized to be received in the openings 150 and 152 respectively when the recesses 192 and 194 receive the respective portions of the pivot holders 122 and 124 such that the generally transverse axes 134 and 204 coincide to permit the through-openings 200 and 202 to receive the pivot 136 along the generally transverse axis 134. The pivot 136 thus functions as a transverse hinge for hingedly connecting the midsole end 176 of the toe sole body 106 to the midsole end 116 of the posterior sole body 104. Further, the stop surfaces 138, 140, 142, 144, 146, 148, 206, 208, 210, and 212 are positioned such that when the recesses 192 and 194 receive the respective portions of the pivot holders 122 and 124 and when the through-openings 126, 128, 130, 132, 200, and 202 receive the pivot 136, the toe sole body 106 may pivot about the pivot 136 to deflect longitudinally relative to the posterior sole body 104 in a first deflection direction 214 (shown in FIGS. 4 and 5) and in a second deflection direction 216 opposite the first deflection direction 214.

Figure 4:
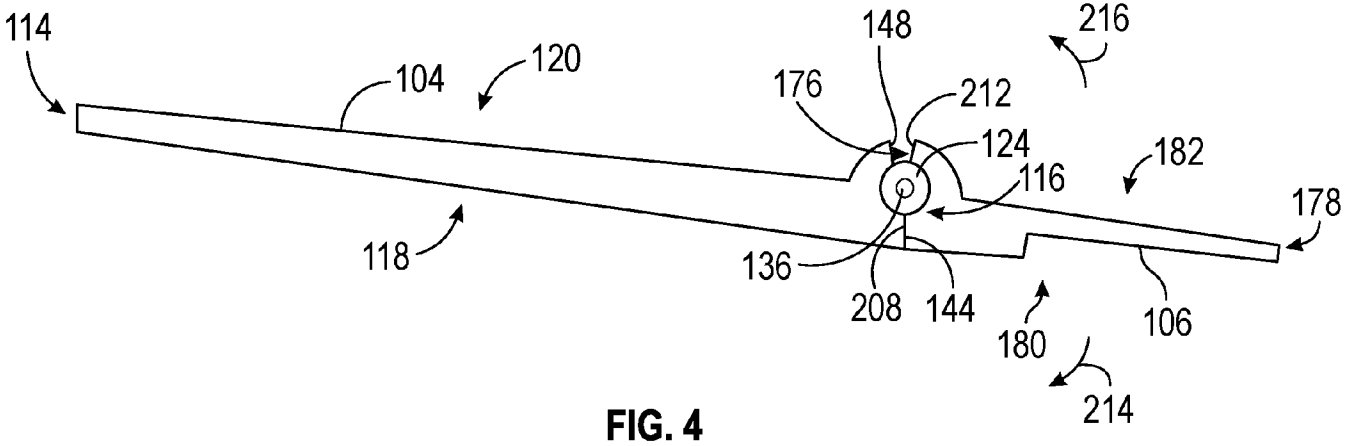
FIG. 4 is an elevation view of the posterior sole body of FIG. 2 and the toe sole body of FIG. 3 illustrating a maximum longitudinal deflection of the toe sole body of FIG. 3 relative to the posterior sole body of FIG. 2 in a first deflection direction.

Referring to FIGS. 2, 3, and 4, in response to longitudinal deflection of the toe sole body 106 relative to the posterior sole body 104 in the first deflection direction 214, the stop surfaces 138 and 140 abut the stop surface 206 and the stop surfaces 142 and 144 abut the stop surface 208 to restrict longitudinal deflection of the toe sole body 106 relative to the posterior sole body 104 in the first deflection direction 214. Also, referring to FIGS. 2, 3, and 5, in response to longitudinal deflection of the toe sole body 106 relative to the posterior sole body 104 in the second deflection direction 216, the stop surfaces 146 and 148 abut the stop surfaces 210 and 212 respectively to restrict longitudinal deflection of the toe sole body 106 relative to the posterior sole body 104 in the second deflection direction 216. The stop surfaces 138, 140, 142, 144, 146, 148, 206, 208, 210, and 212 thus define a maximum longitudinal deflection range 218 between a maximum longitudinal deflection of the toe sole body 106 relative to the posterior sole body 104 in the first deflection direction 214 (shown in FIG. 4) and a maximum longitudinal deflection of the toe sole body 106 relative to the posterior sole body 104 in the second deflection direction 216 (shown in FIG. 5).

Figure 6:
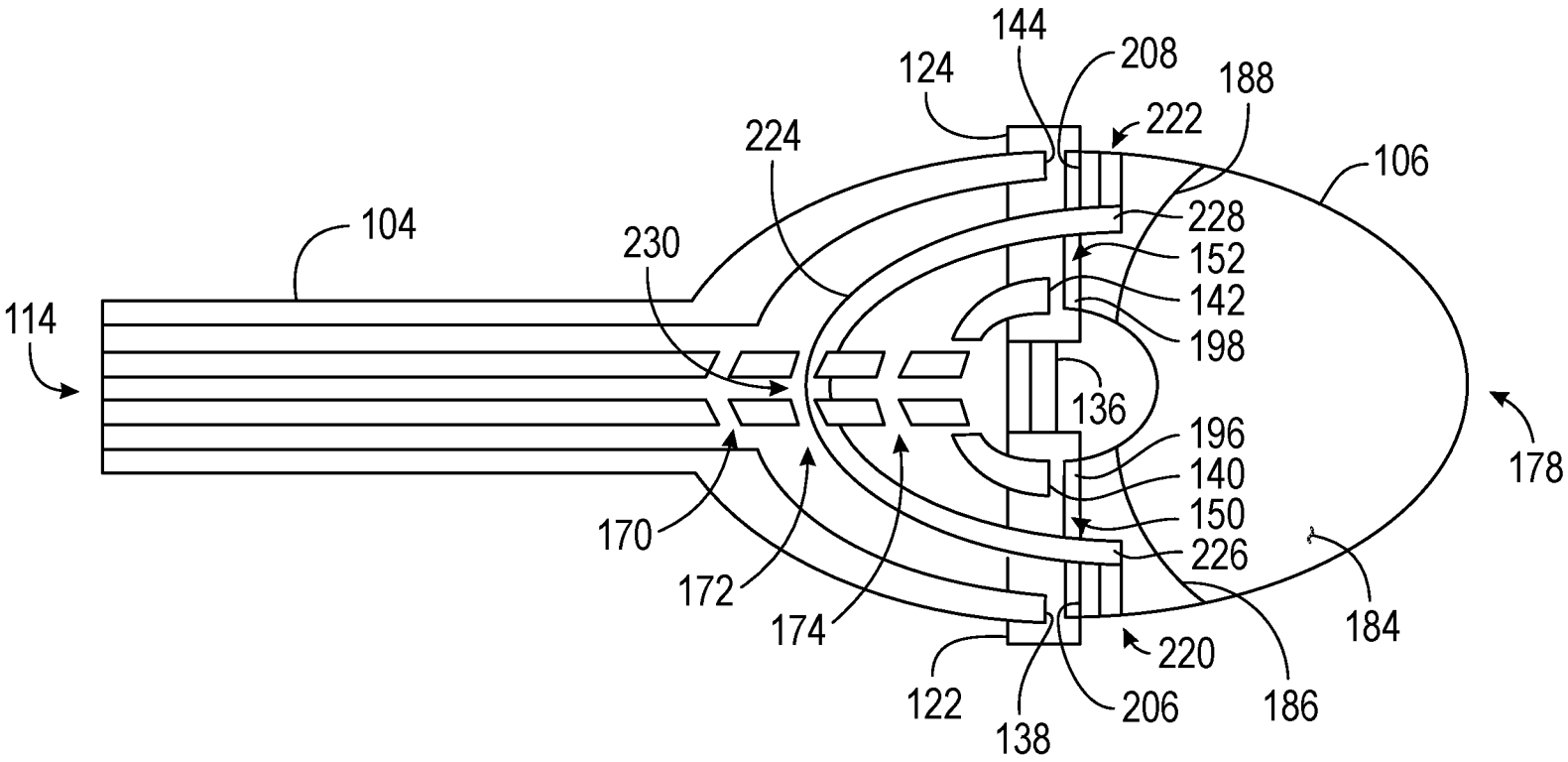
FIG. 6 is a bottom view of the posterior sole body of FIG. 2 and the toe sole body of FIG. 3.

Referring back to FIG. 3, on the bottom side 180 and towards the toe end 178, the toe sole body 106 defines laterally opposite receptacles 220 and 222 for receiving and retaining respective portions of a resilient body, such as an elastomeric body 224 shown in FIG. 6 for example. The laterally opposite receptacles 220 and 222 may more generally be referred to as resilient body connectors. Referring to FIGS. 3 and 6, the receptacles 220 and 222 include respective relatively wide portions for receiving relatively wide end portions of the elastomeric body 224, and the receptacles 220 and 222 include respective relatively narrow portions adjacent the respective relatively wide portions for retaining the relatively wide end portions of the elastomeric body 224. Further, the receptacles 220 and 222 are open at respective opposite sides of the toe sole body 106 to receive respective end portions 226 and 228 of the elastomeric body 224 as shown in FIG. 6.

Referring to FIG. 6, a middle portion shown generally at 230 of the elastomeric body 224 is received in the generally transverse gap 172, and may alternatively be received in the generally transverse gap 170 or in the generally transverse gap 174. Because the generally transverse gaps 170, 172, and 174 are spaced apart from each other longitudinally, moving the middle portion 230 of the elastomeric body 224 to different ones of the generally transverse gaps 170, 172, and 174 may vary a tension of the elastomeric body 224, and varying the tension of the elastomeric body 224 may adjust a tendency of the toe sole body 106 to deflect longitudinally relative to the posterior sole body 104. Moving the middle portion 230 of the elastomeric body 224 to different ones of the generally transverse gaps 170, 172, and 174 may thus vary a flexibility of a boot sole including the posterior sole body 104 and the toe sole body 106, which may be desirable in some swimming or diving applications for example. Also, flexibility of such a boot sole may be varied by varying a material of the elastomeric body 224. The generally transverse gaps 170, 172, and 174 may more generally be referred to as resilient body connectors defined by the posterior sole body 104.

Figure 7:
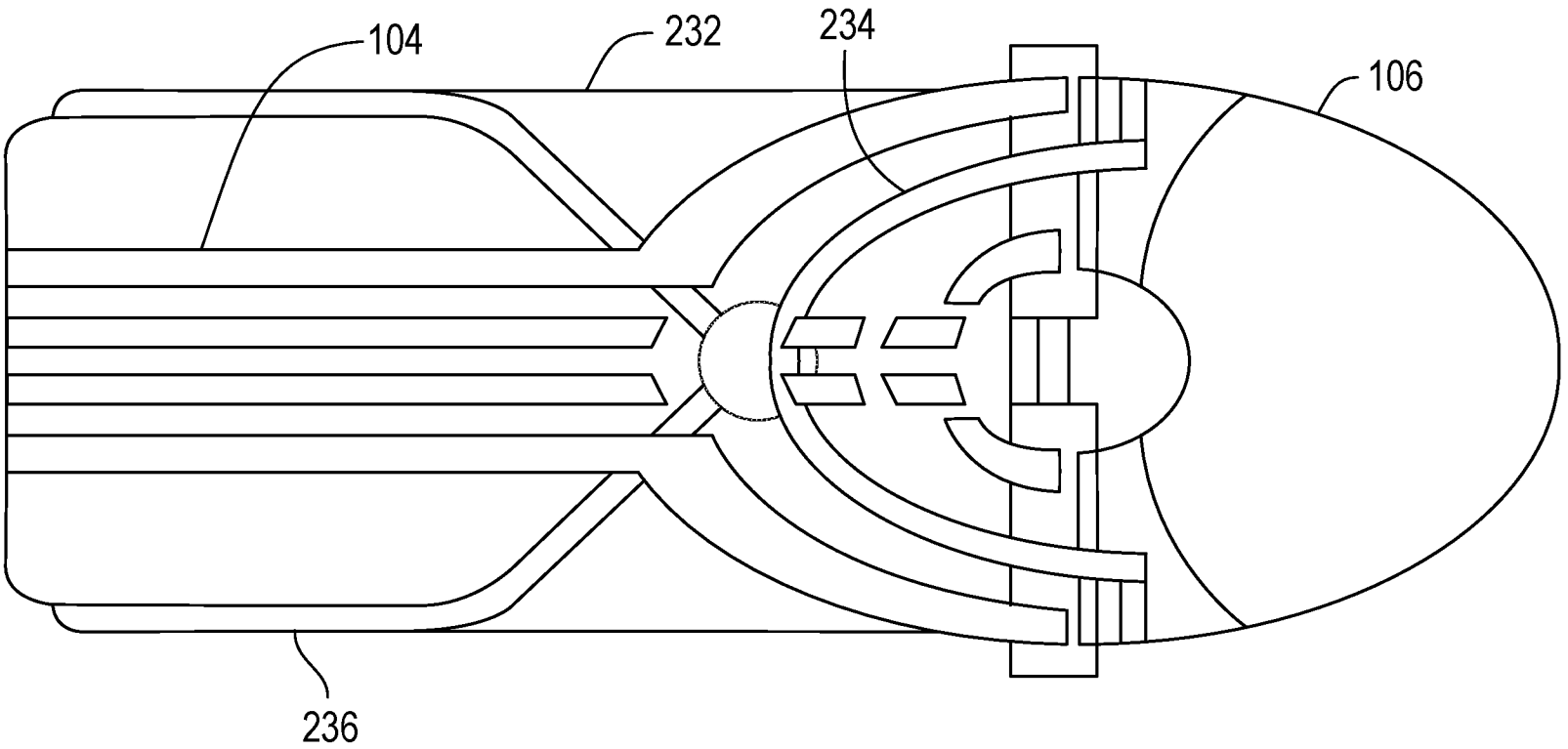
FIG. 7 is a bottom view of a boot system according to another illustrative embodiment.
Figure 8:
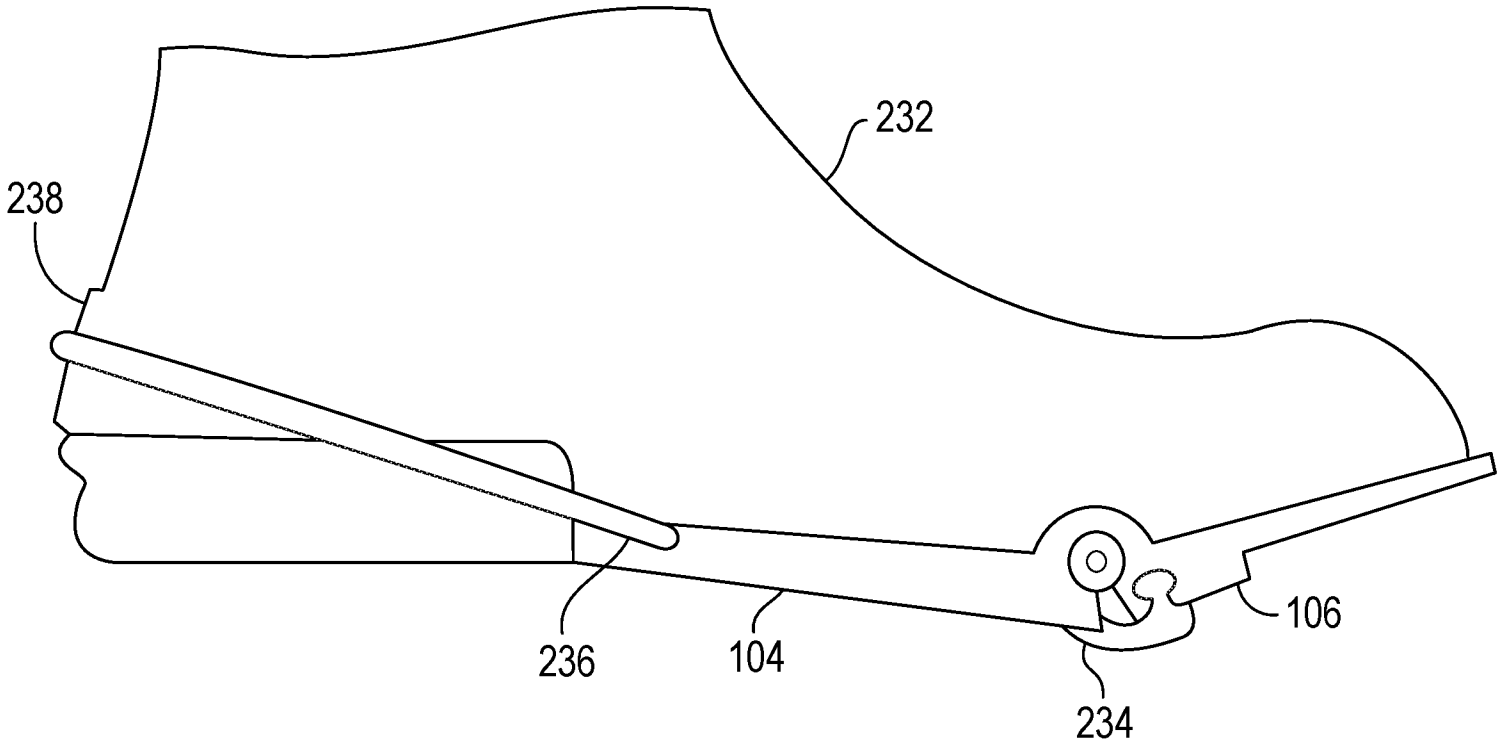
FIG. 8 is an elevation view of the boot system of FIG. 7.

Referring to FIGS. 7 and 8, a boot system according to another illustrative embodiment includes a boot 232 including a boot sole integrally formed with the posterior sole body 104 and the toe sole body 106. An elastomeric body 234 extends from the sole body 106 to the posterior sole body 104 as shown in FIG. 6, except that the elastomeric body 234 includes a heel strap 236 sized to extend laterally around a heel region of the boot 232 and attach to a heel strap attachment 238 near a heel end of the boot 232 for attaching the heel strap 236 to the boot 232. Attaching the heel strap 236 to the heel strap attachment 238 may vary a tension of the elastomeric body 234 to vary a flexibility of the boot sole as described above. In some embodiments, the heel strap attachment 238 may permit the heel strap 236 to be attached to the boot 232 in a plurality of positions, and attaching the heel strap 236 to the boot 232 in different ones of the plurality of positions may vary the tension of the elastomeric body 234 to vary the flexibility of the boot sole as described above.

Figure 9:
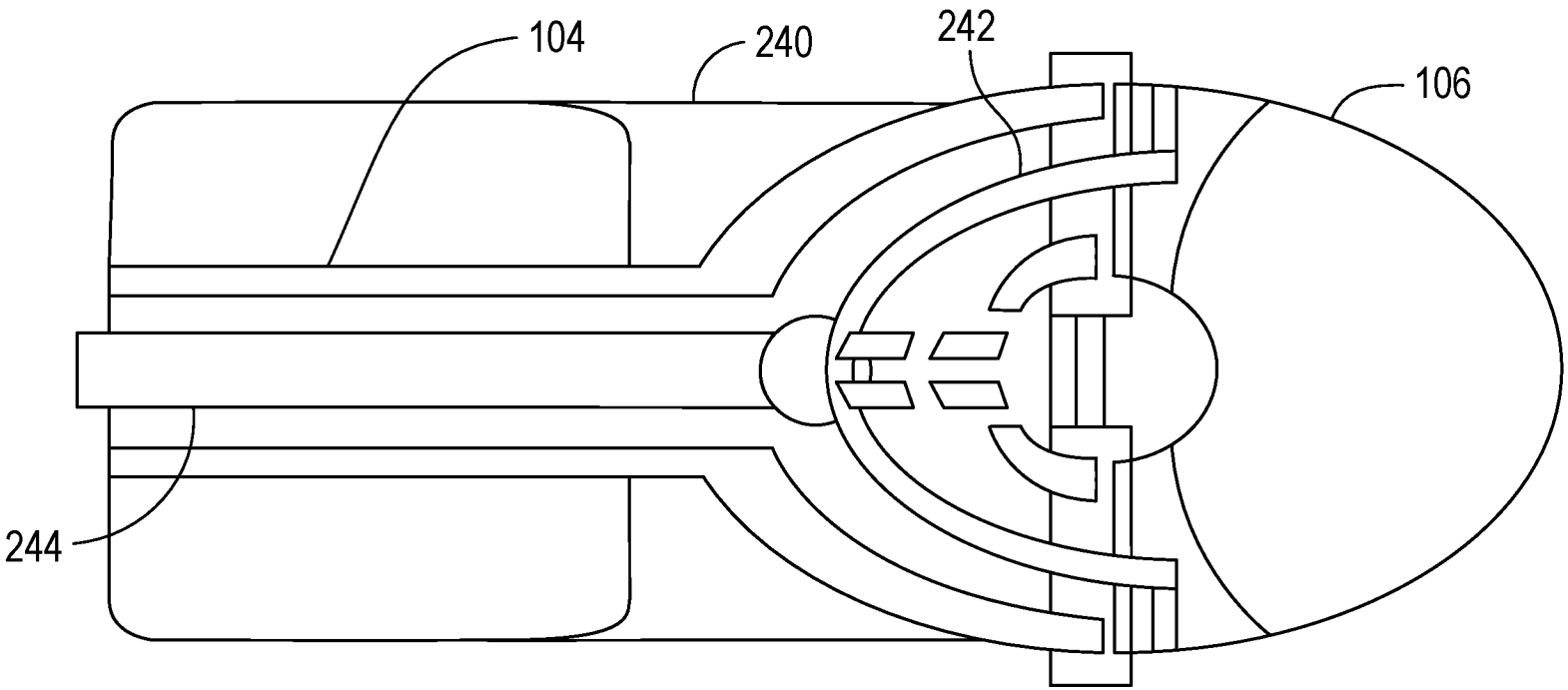
FIG. 9 is a bottom view of a boot system according to another illustrative embodiment.
Figure 10:
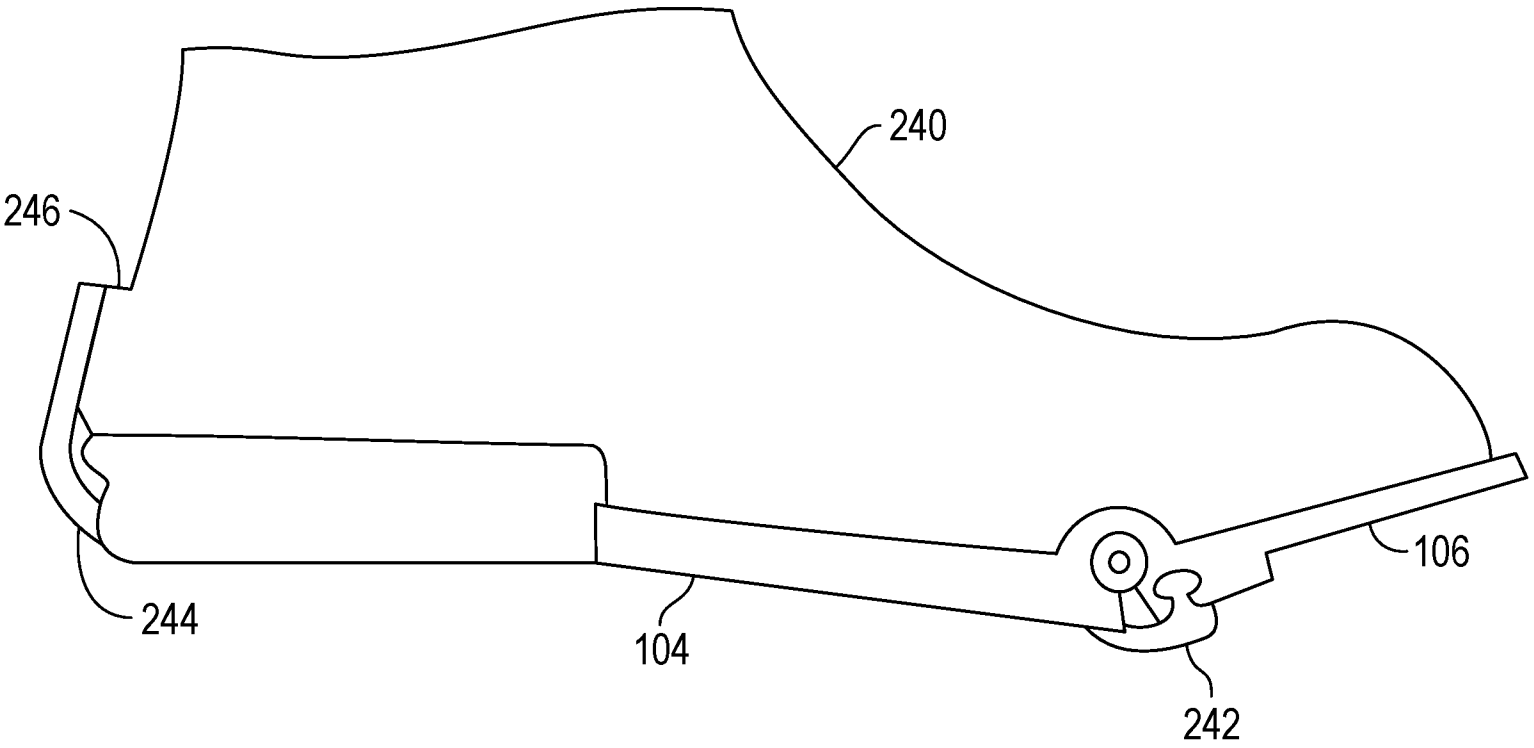
FIG. 10 is an elevation view of the boot system of FIG. 9.

Referring to FIGS. 9 and 10, a boot system according to another illustrative embodiment includes a boot 240 including a boot sole integrally formed with the posterior sole body 104 and the toe sole body 106. An elastomeric body 242 extends from the sole body 106 to the posterior sole body 104 as shown in FIG. 6, except that the elastomeric body 242 includes a heel strap 244 sized to extend under a heel region of the boot 240 on a bottom side of the boot 240 and attach to a heel strap attachment 246 near a heel end of the boot 240 for attaching the heel strap 244 to the boot 240. Attaching the heel strap 244 to the heel strap attachment 246 may vary a tension of the elastomeric body 242 to vary a flexibility of the boot sole as described above. In some embodiments, the heel strap attachment 246 may permit the heel strap 244 to be attached to the boot 240 in a plurality of positions, and attaching the heel strap 244 to the boot 240 in different ones of the plurality of positions may vary the tension of the elastomeric body 242 to vary the flexibility of the boot sole as described above.

Figure 11:
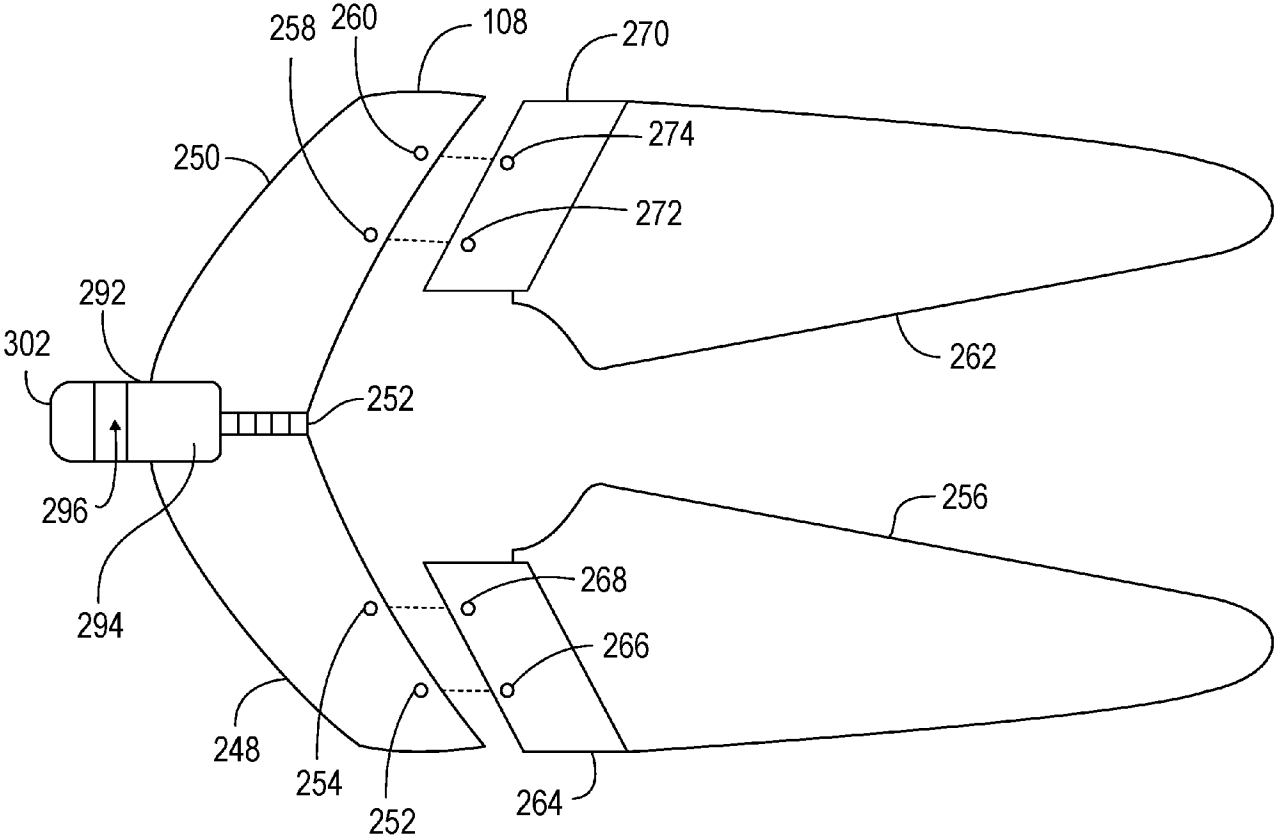
FIG. 11 is an exploded bottom view of a frame of the boot system of FIG. 1 and fin elements of a fin.

Referring to FIG. 11, the frame 108 includes first and second laterally opposite frame elements 248 and 250 and a longitudinal hinge 252 hingedly connecting the first and second laterally opposite frame elements 248 and 250. The first laterally opposite frame element 248 defines through-openings 252 and 254 for connecting the first laterally opposite frame element 248 to a fin element 256, and the second laterally opposite frame element 250 defines through-openings 258 and 260 for connecting the second laterally opposite frame element 250 to a fin element 262. The fin element 256 includes a hinge element 264 defining through-openings 266 and 268; a fastener (not shown) may pass through the through-openings 252 and 266 and another fastener (not shown) may pass through the through-openings 254 and 268 to connect the first laterally opposite frame element 248 to the fin element 256. Also, the fin element 262 includes a hinge element 270 defining through-openings 272 and 274; a fastener (not shown) may pass through the through-openings 258 and 272 and another fastener (not shown) may pass through the through-openings 260 and 274 to connect the second laterally opposite frame element 250 to the fin element 262. However, alternative embodiments may include different fins which may be attached to the frame 108 in different ways.

Figure 12:
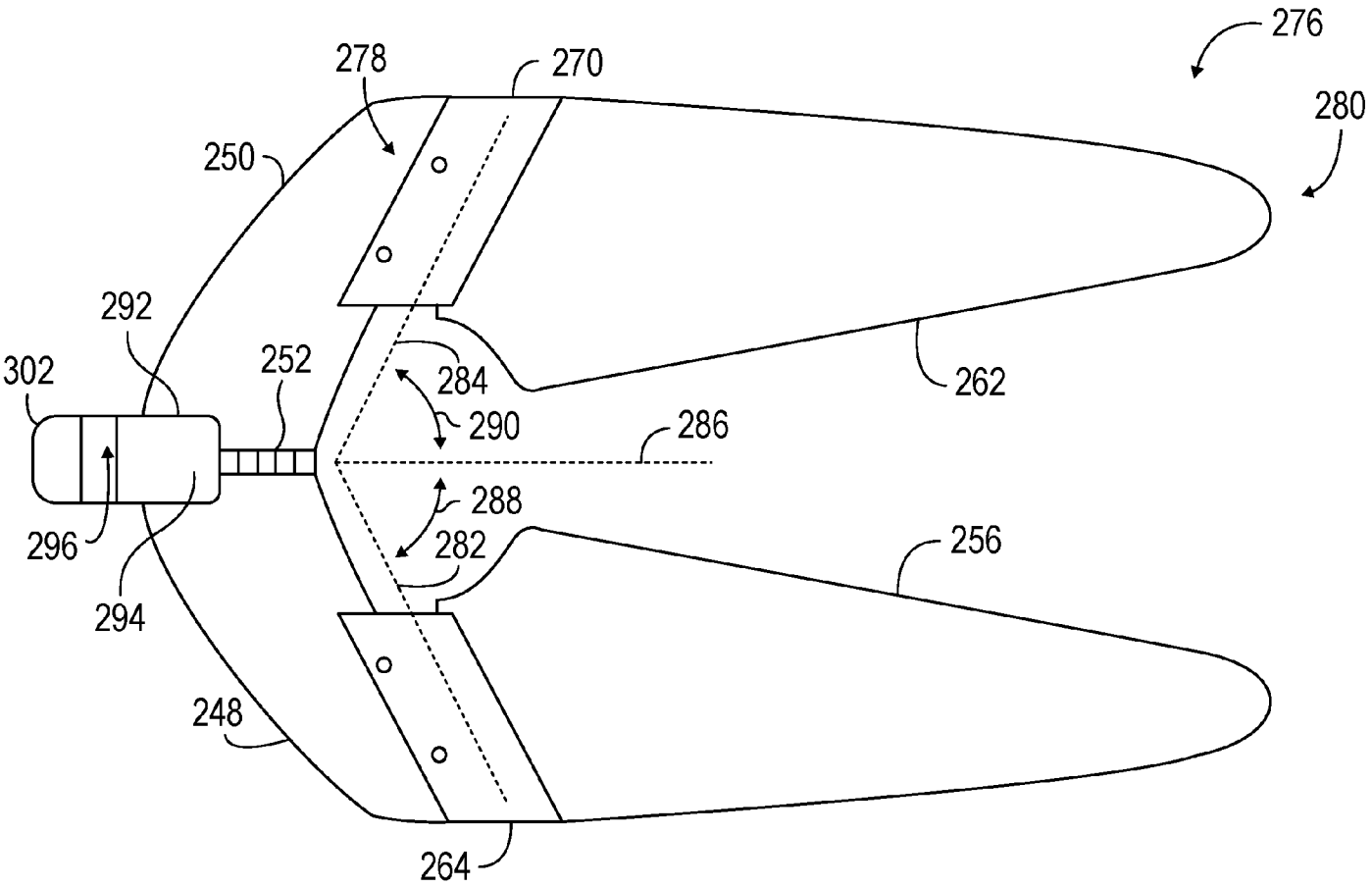
FIG. 12 is a bottom view of the frame and the fin of FIG. 11.

Referring to FIG. 12, when the first laterally opposite frame element 248 is connected to the fin element 256 and the second laterally opposite frame element 250 is connected to the fin element 262, the fin elements 256 and 262 form a fin shown generally at 276. The fin 276 is thus connectable to the frame 108. In alternative embodiments, the fin may be permanently connected to the frame, but nevertheless such a fin may be referred to as "connectable" to the frame. In general, "connectable" herein may refer to a permanent connection or to a selectable connection.

The fin 276 has a proximal end shown generally at 278 and a distal end shown generally at 280 and opposite the proximal end 278. Further, the hinge element 264 has a hinge axis 282 and the hinge element 270 has a hinge axis 284. The hinge axis 282 extends away from a central longitudinal axis 286 of the fin 276 and towards the distal end 280 at an acute angle 288, and the hinge axis 284 extends away from the central longitudinal axis 286 of the fin 276 and towards the distal end 280 at an acute angle 290. The fin 276 may therefore spread apart in response to lateral deflection of the fin 276 relative to the frame 108 similarly to various fins described and illustrated in U.S. patent application Ser. No. 13/639,446, originally published as WO 2011/123950 A1. The entire contents of U.S. patent application Ser. No. 13/639,446 are incorporated by reference herein. As indicated above, alternative embodiments may include different fins which may include fins similar to those described in and illustrated in WO 2011/123950 A1 or still other fins.

Figure 13:
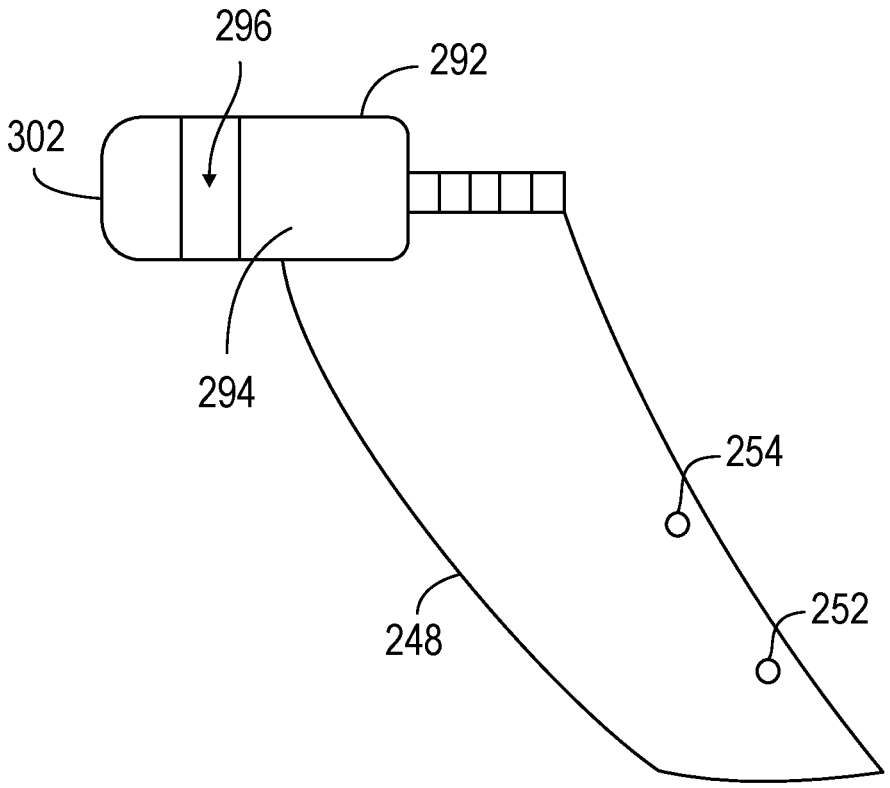
FIG. 13 is a bottom view of the frame of FIG. 11 when folded along a longitudinal hinge of the frame of FIG. 11.

Referring to FIGS. 11, 12, and 13, the frame 108 includes a connector 292 for connecting the frame 108 to the pivot 136 (shown in FIGS. 1 and 4 to 6). The connector 292 includes a generally planar flange 294 fastened to the first laterally opposite frame element 248 but not fastened to the second laterally opposite frame element 250. Therefore, when the first and second laterally opposite frame elements 248 and 250 are extended apart from each other around the longitudinal hinge 252 (as shown in FIGS. 11 and 12), the second laterally opposite frame element 250 abuts the generally planar flange 294 and the generally planar flange 294 prevents further rotation of the second laterally opposite frame element 250 around the longitudinal hinge 252, thus maintaining the first and second laterally opposite frame elements 248 and 250 generally coplanar. However, the second laterally opposite frame element 250 may be pivoted around the longitudinal hinge 252 away from the generally planar flange 294 and towards the first laterally opposite frame element 248, effectively permitting the frame 108 to be folded around the longitudinal hinge 252. Folding the frame 108 around the longitudinal hinge 252 may reduce space consumed by the frame 108, and reduced space may be desirable in some applications such as storing or transporting the frame 108 for example.

Figure 14:
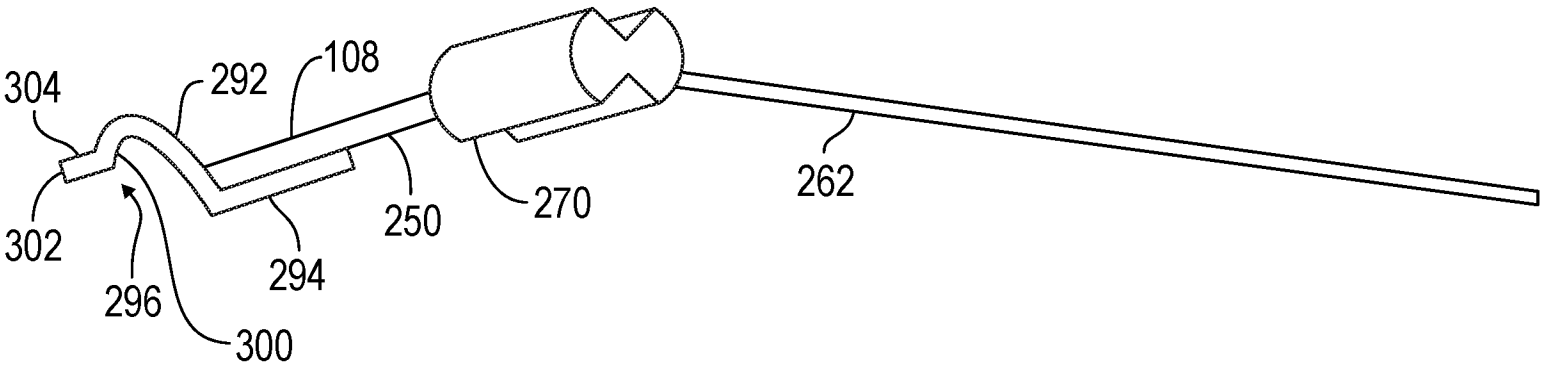
FIG. 14 is an elevation view of the frame and the fin of FIG. 11.
Figure 15:
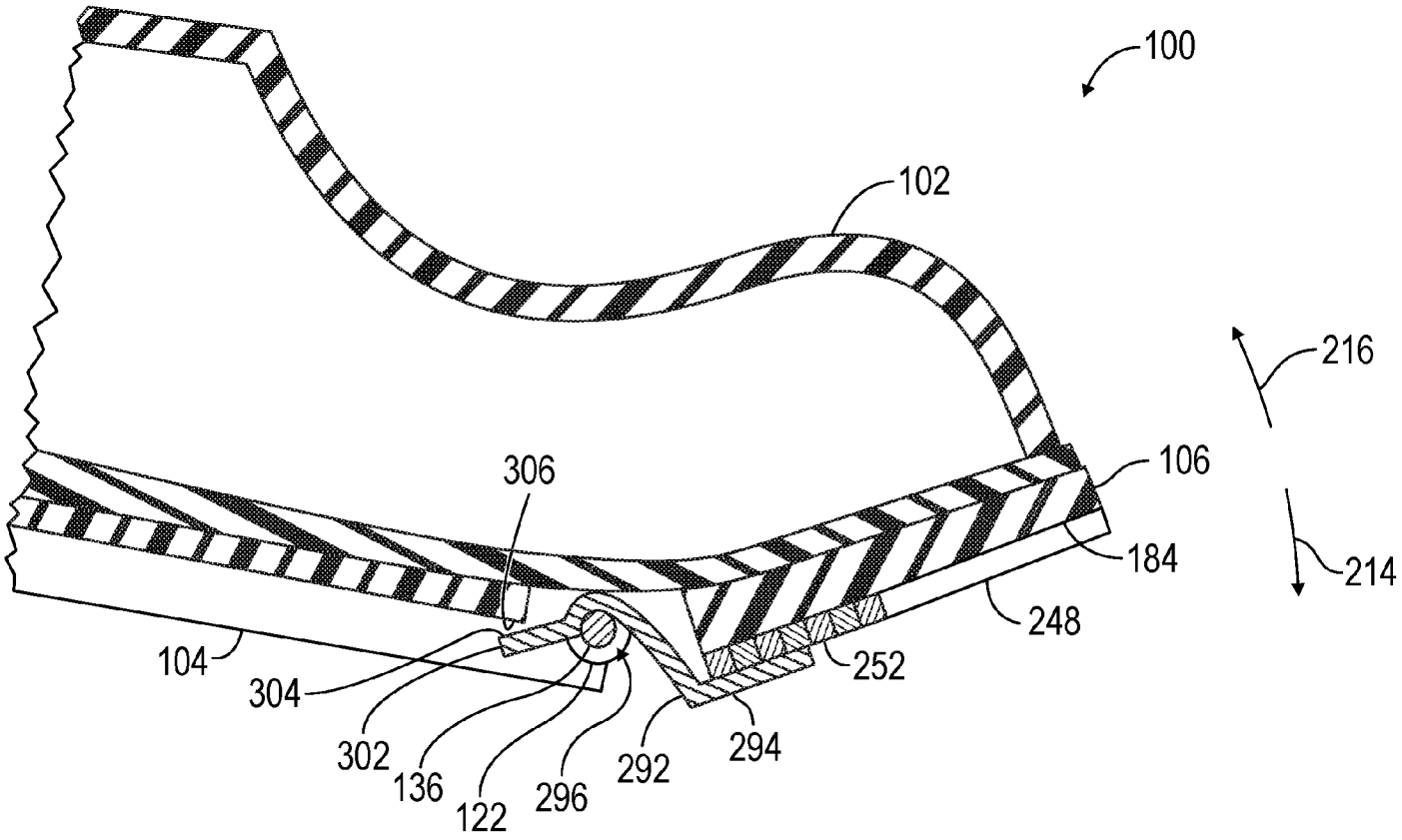
FIG. 15 is a cross-sectional view of the boot system of FIG. 1 and the fin of FIG. 11.

Referring to FIGS. 14 and 15, the connector 292 defines a receptacle shown generally at 296 and sized to receive a portion of the pivot 136 to connect the frame 108 to the pivot 136. As shown in FIG. 1, the pivot 136 includes a threaded end shown generally at 298, and the through-opening 126 defines complementary threads (not shown) to hold the pivot 136 in the through-openings 126, 128, 130, 132, 200, and 202 (shown in FIGS. 2 and 3) when the generally transverse axes 134 and 204 coincide (shown in FIGS. 2 and 3). The pivot 136 is thus removable from the posterior sole body 104 and from the toe sole body 106 by removing the threaded end 298 from the complementary threads of the through-opening 126. In alternative embodiments, the pivot 136 may be held by a friction fit instead of by threads. When the pivot 136 thus removed, the frame 108 may be positioned with a portion of the connector 292 between the pivot holders 122 and 124 (shown in FIG. 2), and the receptacle 296 is configured to receive the pivot 136 when the frame 108 is thus positioned, as shown in FIG. 15. The receptacle 296 defines a retaining surface 300 in the receptacle 296 that abuts the pivot 136 when the receptacle 296 receives the pivot 136 as shown in FIG. 15 to retain the connector 292 and thus the frame 108 to the pivot 136. The frame 108 is thus removably connectable to the posterior sole body 104 at the pivot 136.

As indicated above, the generally planar flange 294 prevents rotation of the second laterally opposite frame element 250 around the longitudinal hinge 252 beyond the generally planar flange 294. Further, in FIG. 15, the first and second laterally opposite frame elements 248 and 250 abut the generally planar abutment surface 184, and the generally planar abutment surface 184 thus prevents rotation of the second laterally opposite frame element 250 around the longitudinal hinge 252 away from the generally planar flange 294. Therefore, as shown in FIG. 15, when the first and second laterally opposite frame elements 248 and 250 abut the generally planar abutment surface 184, the generally planar abutment surface 184 and the generally planar flange 294 maintain the first and second laterally opposite frame elements 248 and 250 generally coplanar.

The connector 292 also defines a stop 302 having a stop surface 304. Referring to FIG. 15, in response to longitudinal deflection of the frame 108 relative to the posterior sole body 104 in the first deflection direction 214, the stop surface 304 abuts a stop surface 306 (also shown in FIG. 2) on the posterior sole body 104 to restrict longitudinal deflection of the frame 108 relative to the posterior sole body 104 in the first deflection direction 214.

Therefore, both the toe sole body 106 and the frame 108 are connected to the pivot 136 and may pivot about the pivot 136 for longitudinal deflection relative to the posterior sole body 104 in the first deflection direction 214 and in the second deflection direction 216.

In operation, when a foot of a user (not shown) is received in the boot 102, the pivot 136 may be proximate metatarsophalangeal joints (or simply toe joints) of the user. In other words, one or both of the toe sole body 106 and the frame 108 may deflect longitudinally with the toes of the user. Therefore, the frame 108 may also be referred to as a "toe sole body" and the toe sole body 106 and the frame 108 may collectively be referred to as "at least one toe sole body" connectable to a fin (the fin 276 shown in FIG. 12 in the embodiment shown) because at least one of the at least one toe sole body (the frame 108 in the embodiment shown) is connectable to the fin.

Although the pivot 136 is referred to herein as a transverse hinge, the pivot 136 (and other transverse hinges described herein) do not necessarily extend perpendicular to any longitudinal axis. Rather, in the embodiment shown in FIG. 15 for example, the pivot 136 may extend under metatarsophalangeal joints of a user, which may follow a curve that is not perpendicular to any longitudinal axis. More generally, transverse hinges described herein may extend transversely at various angles that may be desired in various embodiments but that are not necessarily perpendicular to any longitudinal axis. Although the transverse hinge in the embodiment shown is the pivot 136, transverse hinges in other embodiments may include other hinges, such as thermoplastic hinges for example.

Referring to FIGS. 1 and 15, because the first and second laterally opposite frame elements 248 and 250 abut the generally planar abutment surface 184, and because the generally planar abutment surface 184 is on the toe sole body 106 that may be below (or "inferior to") toes of a user as shown in FIG. 15, the first and second laterally opposite frame elements 248 and 250 may extend laterally from below (or "inferior to") toes of the user rather than from in front of (or "anterior to") the toes of the user. In such embodiments, an overall length of the boot system 100 and the fin 276 (shown in FIG. 12) may be shorter when compared to some other fins that do not include structure below (or "inferior to") toes of a user and instead include more structure and spacing in front of (or "anterior to") the toes of the user. Such reduced overall length may be advantageous in some applications where compactness of a fin may be desirable. Further, reduced overall length may improve a mechanical advantage of a user's leg and reduce strain on the user's leg because when the fin is closer to the user's hip, knee, ankle, and toe joints, less force is required to move the fin by a given angle about such joints.

In the embodiment shown in FIG. 15, the toe sole body 106 and the frame 108 do not necessarily move together, and for example when a user wearing the boot 102 kicks downward (which would be upward in FIG. 15 if the user is facing down while swimming or diving), then the frame 108 may be deflected longitudinally relative to the posterior sole body 104 in the first deflection direction 214 without necessarily longitudinally deflecting the toe sole body 106 in the first deflection direction 214 to the same extent as the frame 108 or at all. However, in alternative embodiments such as those shown in FIGS. 17 to 24 for example, the frame may be fastened to the toe sole body such that the frame and the toe sole body move together, generally with longitudinal deflection relative to the posterior sole body in substantially similar angles. Also, although the toe sole body 106 and the frame 108 are separate bodies in the embodiment shown, alternative embodiments may include a single toe sole body connectable to a fin and hingedly connectable to a posterior sole body.

Further, the at least one toe sole body (the toe sole body 106 and the frame 108 in the embodiment shown) collectively include at least one stop surface (one or more of the stop surfaces 206, 208, and 304 in the embodiment shown) to restrict longitudinal deflection of the toe sole body 106 relative to the posterior sole body 104 in the first deflection direction 214 and at least one stop surface (one or more of the stop surfaces 210 and 212 in the embodiment shown) to restrict longitudinal deflection of the toe sole body 106 relative to the posterior sole body 104 in the second deflection direction 216, and thus the at least one toe sole body in the embodiment shown includes a stop surface to restrict longitudinal deflection of the toe sole body 106 relative to the posterior sole body 104 in the first deflection direction 214 and a stop surface to restrict longitudinal deflection of the toe sole body 106 relative to the posterior sole body 104 in the second deflection direction 216. In alternative embodiments, one or more of at least one toe sole body may include a stop surface to restrict longitudinal deflection relative to a posterior sole body in a first deflection direction and a stop surface to restrict longitudinal deflection relative to the posterior sole body in a second deflection direction opposite the first deflection direction, and such stop surfaces may be on the same toe sole body or on different toe sole bodies in various embodiments.

Figure 5:
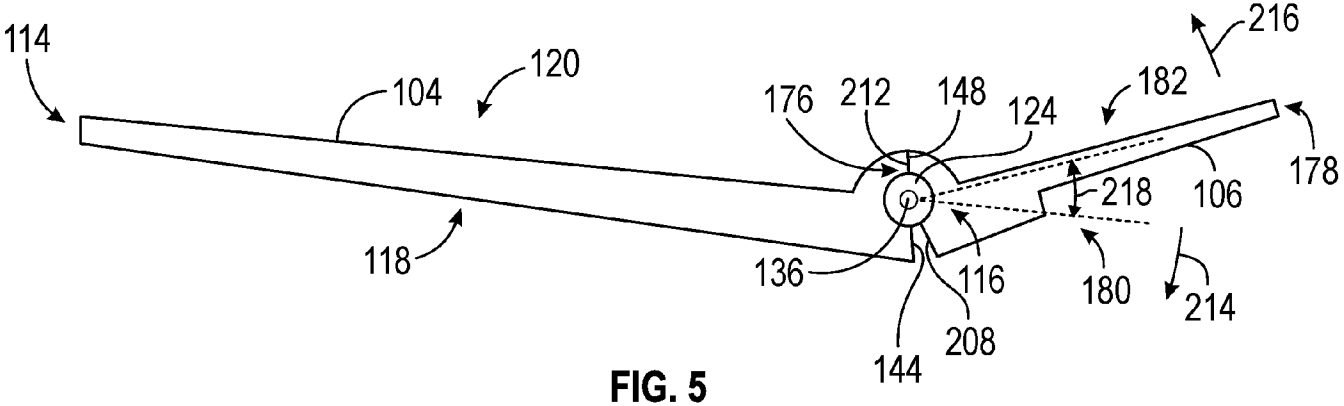
FIG. 5 is an elevation view of the posterior sole body of FIG. 2 and the toe sole body of FIG. 3 illustrating a maximum longitudinal deflection of the toe sole body of FIG. 3 relative to the posterior sole body of FIG. 2 in a second deflection direction.

As shown in FIG. 5, stop surfaces in the embodiment shown restrict longitudinal deflection of the of the toe sole body 106 relative to the posterior sole body 104 to a maximum longitudinal deflection range 218. In some embodiments, the maximum longitudinal deflection range 218 may be within a normal range for bending of metatarsophalangeal joints. In some embodiments, the maximum longitudinal deflection range 218 may range from a position where toes are fully extended forward (or anterior) to a maximum normal superior (that is, towards the head of the user) bending. For example, a maximum normal superior bending of metatarsophalangeal joints may be about 30° to about 80°, and therefore in some embodiments, the maximum longitudinal deflection range 218 may range from a position where toes are fully extended forward (or anterior) to, for example, about 30°, about 35°, about 40°, about 45°, about 50°, about 55°, about 60°, about 65°, about 70°, about 75°, or about 80° superior (that is, towards the head of the user) to the position where toes are fully extended.

In general, the pivot 136 and other transverse hinges such as those described herein may in some embodiments improve a connection between a user's foot and a fin attached to the user's foot when compared to other boot bindings systems. For example, a user of the boot system 100 may sense movement of a fin by sensing movement of the user's toes, which may enhance the user's experience by enhancing the user's awareness of fin movement. Also, the user may control movement of the fin by controlling movement of the user's toes. Still further, allowing movement of the user's toes may permit more natural body movement that may avoid cramps and other potential disadvantages of other boot bindings systems that may not permit such foot movement.

In many applications such as swimming and diving for example, a user faces downward in water. Further, many swimmers and divers have stronger downward kicks (that is, kicks downward when facing downward in water, or kicks that involve straightening or extending the leg at one or more of the hip, knee, ankle, and toe joints) when compared to their upward kicks (that is, kicks upward when facing downward in water, or kicks that involve flexing the leg at one or more of the hip, knee, ankle, and toe joints). In the embodiment shown, when a user kicks downward in such an orientation, resistance in surrounding water generally causes the fin 276, the frame 108, and the toe sole body 106 to deflect upward, or longitudinally relative to the posterior sole body 104 in the first deflection direction 214.

Therefore, as indicated above, in embodiments where the maximum longitudinal deflection in the first deflection direction 214 is a position where toes are fully extended forward (or anterior), then a downward kick (in an orientation where the user is facing downwards) in such embodiments will tend to deflect the fin 276, the frame 108, and the toe sole body 106 longitudinally relative to the posterior sole body 104 in the first deflection direction 214 to the maximum longitudinal deflection in the first deflection direction 214, thereby extending the fin 276 away from the leg.

When the fin 276 is extended away from the leg, the effective surface area of the fin 276 against incident water is increased by orienting the fin 276 generally perpendicular to a direction of motion of the fin 276. Increasing effectiveness of the fin 276 during the downward kick may be desirable where the downward kick is relatively stronger than the upward kick.

Also, in embodiments where the maximum longitudinal deflection range 218 ranges to maximum normal superior bending of metatarsophalangeal joints (such as about 30° to about 80° for example), then an upward kick (in an orientation where the user is facing downwards) causes the fin 276, the frame 108, and the toe sole body 106 to deflect longitudinally relative to the posterior sole body 104 in the second deflection direction 216, thereby angling the fin towards the user's leg and reducing effective surface area of the fin 276 against incident water by orienting the fin 276 generally closer to parallel to a direction of motion of the fin 276 during the relatively weaker upward kick. Therefore, the longitudinal deflection range 218 in various embodiments may allow a fin such as the fin 276 to deflect longitudinally relative to a user's foot to increase and decrease effective surface area of the fin 276 during a kick cycle to increase effectiveness of the relatively stronger downward stroke while facilitating the relatively weaker upward stroke by reducing resistance during the upward stroke.

Further, in embodiments where the longitudinal deflection range 218 is limited by a maximum longitudinal deflection in the second deflection direction 216 corresponding to a maximum normal superior bending of metatarsophalangeal joints (such as about 30° to about 80° for example), the longitudinal deflection range 218 may in some such embodiments prevent damage to metatarsophalangeal joints, or bones or other tissue surrounding the metatarsophalangeal joints, that could result from bending the metatarsophalangeal joints beyond normal bending. For example, when a user jumps out of a boat or off of a dock and into water feet-first, fins attached to the user's feet will naturally be deflected upward in response to resistance in the water surrounding the fin, and forcefully under the user's body weight and speed of motion. However, the longitudinal deflection range 218 in some embodiments may prevent such damage that could result from such forceful upward deflection of the fin 276, in the embodiment shown because the stop surfaces 146 and 148 abut the stop surfaces 210 and 212 respectively to restrict longitudinal deflection of the toe sole body 106 relative to the posterior sole body 104 in the second deflection direction 216.

In the embodiment shown, the toe sole body 106 and the frame 108 both directly connect to the pivot 136. However, in alternative embodiments, only one of the toe sole body 106 and the frame 108 may be connected directly to the pivot 136. For example, in some embodiments, the frame 108 may not connect directly to the pivot 136, but may connect instead to the toe sole body 106. However, in such embodiments, the frame 108 may still be referred to as connected to the pivot 136 because the frame 108 is indirectly connected to the pivot 136 through the toe sole body 106.

Figure 16:
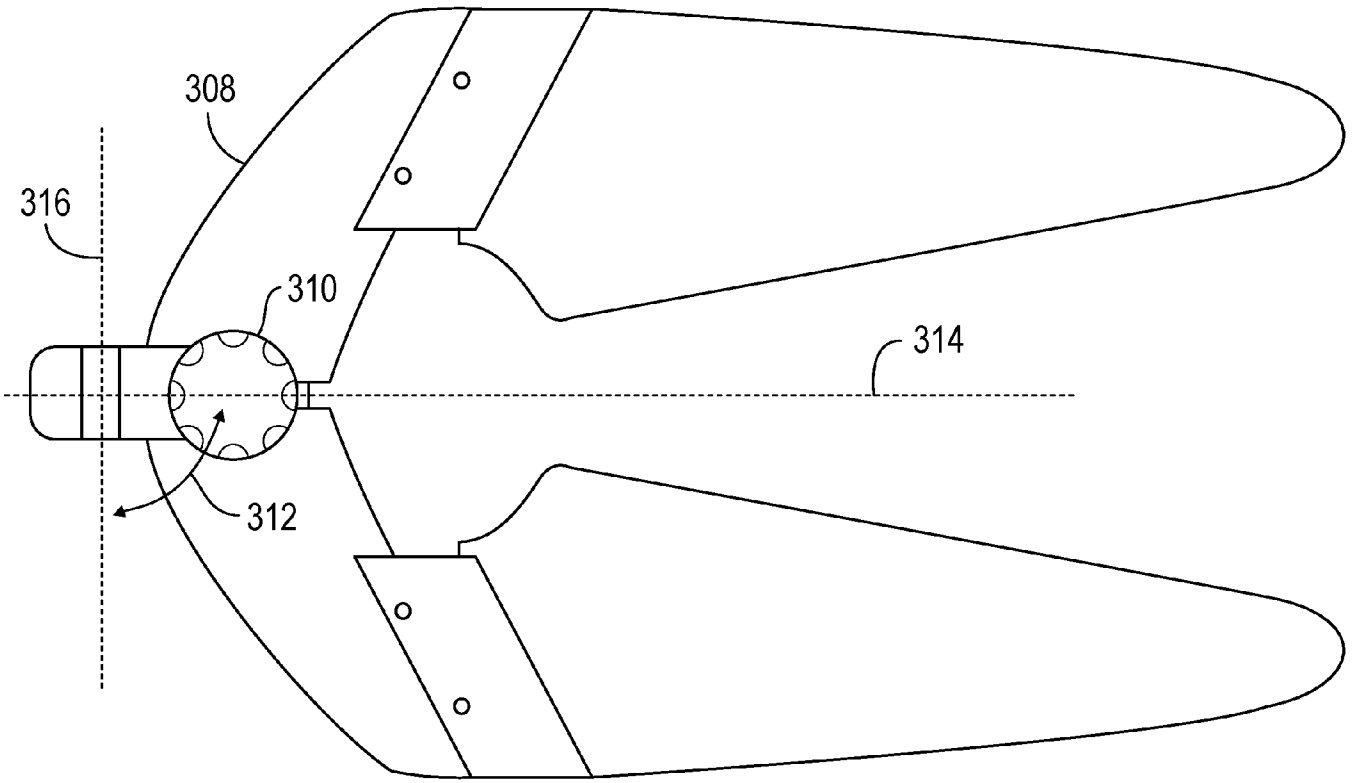
FIG. 16 is a bottom view of a frame and a fin according to another illustrative embodiment.

Referring to FIG. 16, a frame 308 according to another illustrative embodiment is substantially the same as the frame 108 described above, but includes an actuator 310 in communication with one or more gears (not shown) that, when rotated, vary an angle 312 between a central longitudinal axis 314 of a fin connected to the frame 308 and a transverse axis 316 of a receptacle of the frame 308 for receiving a transverse pivot. For example, in some embodiments, a connector (similar to the connector 292 described above) of the frame 308 may be pivotally coupled to first and second laterally opposite frame elements (similar to the first and second laterally opposite frame elements 248 and 250 described above) of the frame 308 and the actuator 310 may be in communication with a pinion (not shown) on the connector of the frame 308 and in geared engagement with a static rack (not shown) on one of the first and second laterally opposite frame elements of the frame 308 such that rotation of the pinion causes the connector of the frame 308 to move along the rack, thereby pivoting the connector of the frame 308 relative to the first and second laterally opposite frame elements of the frame 308 and changing the angle 312. In other embodiments where the connector of the frame 308 is pivotally coupled to the first and second laterally opposite frame elements of the frame 308, the actuator 310 may be in communication with a worm (not shown) on the connector of the frame 308 and in geared engagement with a static worm gear (not shown) on one of the first and second laterally opposite frame elements of the frame 308 such that rotation of the worm causes the worm move along the static worm gear, thereby pivoting the connector of the frame 308 relative to the first and second laterally opposite frame elements of the frame 308 and changing the angle 312. Adjusting the angle 312 may, for example, compensate for "pigeon-toed" or "bowlegged" foot orientations of some users, and more generally may allow users to vary angles between feet of the user and fins attached to the feet of the user.

Figure 17:
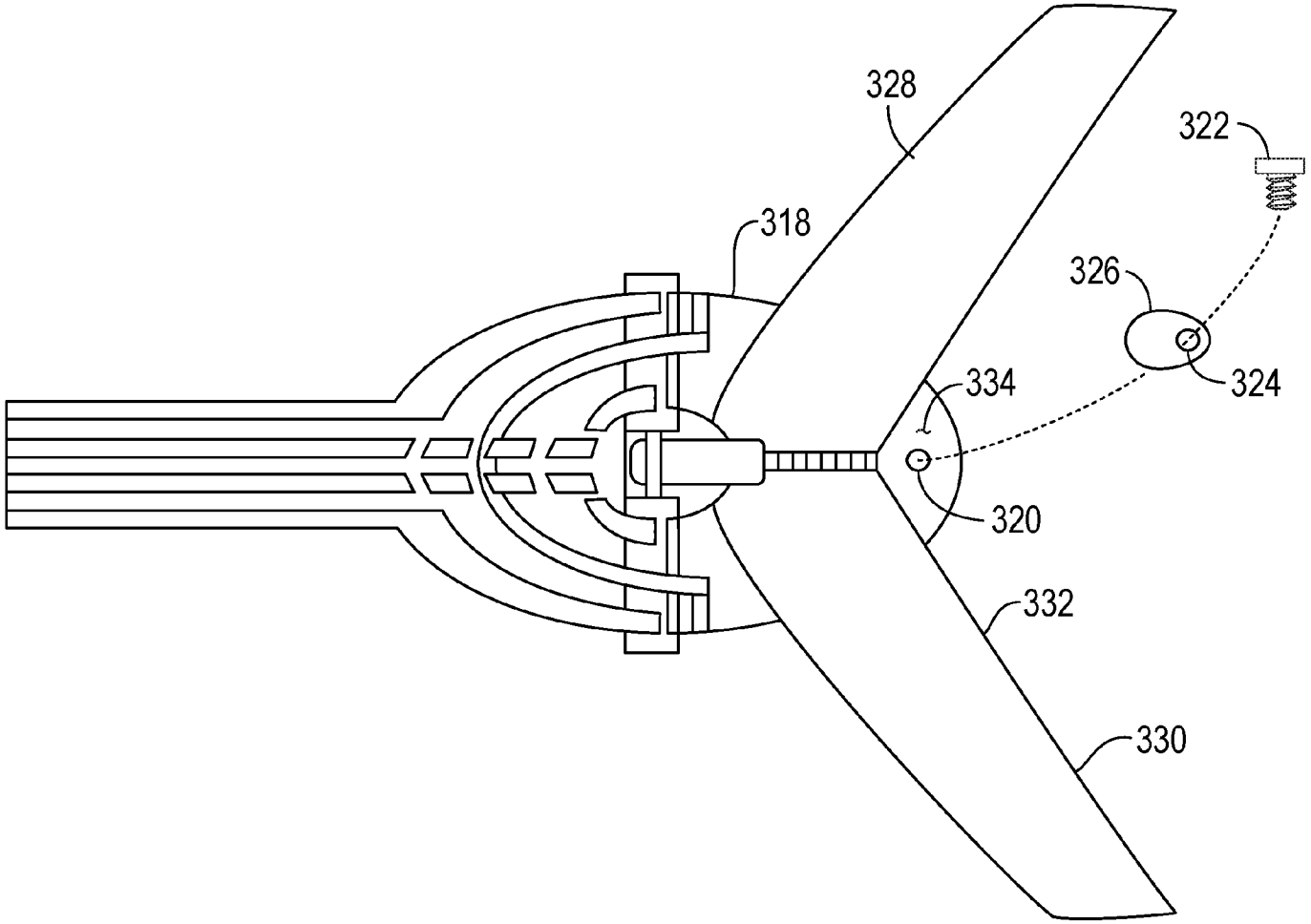
FIG. 17 is an exploded bottom view of a boot sole system according to another illustrative embodiment.
Figure 18:
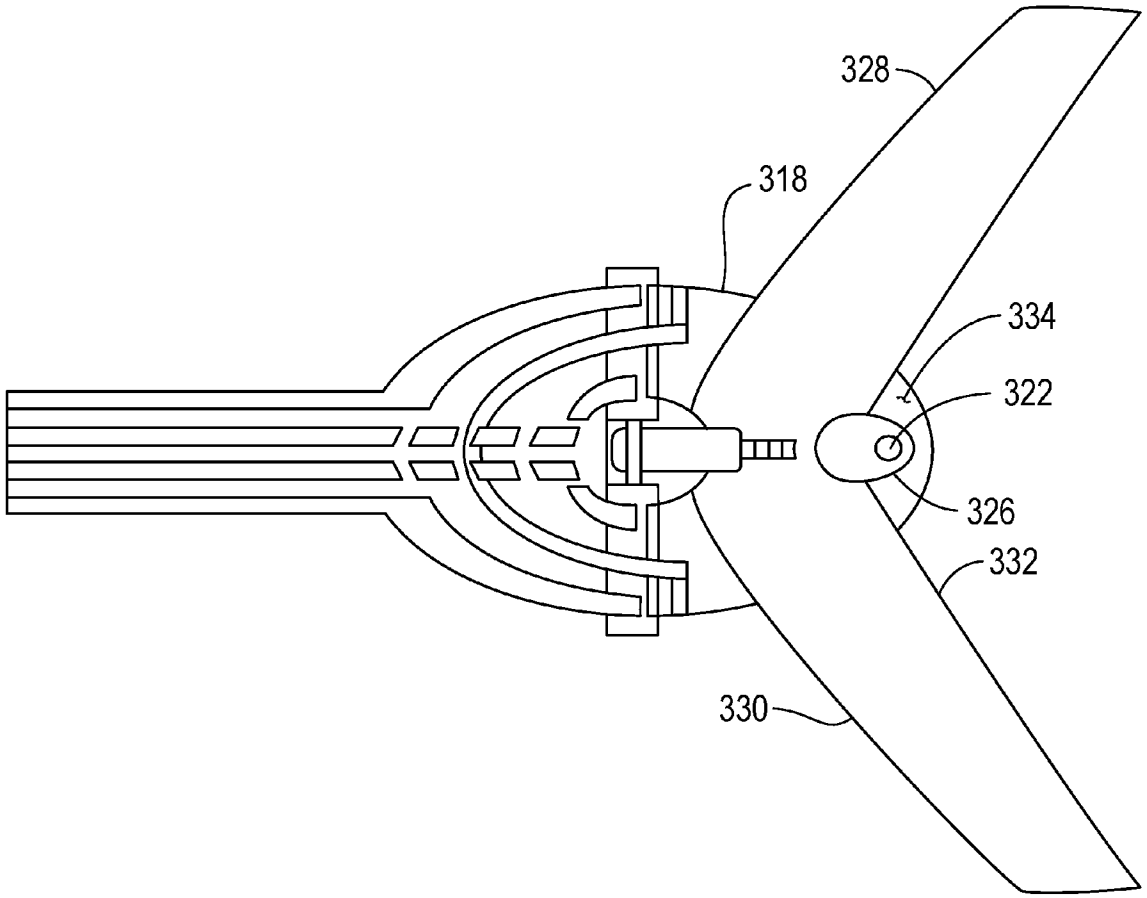
FIG. 18 is an assembled bottom view of the boot sole system of FIG. 17.

Referring to FIGS. 17 and 18, a toe sole body 318 according to another illustrative embodiment is substantially the same as the toe sole body 106 described above, but defines a threaded opening 320 for receiving a threaded fastener 322. The threaded fastener 322 may also be received in a through-opening 324 of a retainer 326 such that the threaded fastener 322 retains the retainer 326 against first and second laterally opposite frame elements 328 and 330 of a frame 332 that is substantially the same as the frame 108, and such that the retainer 326 retains the first and second laterally opposite frame elements 328 and 330 against a generally planar abutment surface 334 (similar to the generally planar abutment surface 184 shown in FIGS. 1, 3, and 15) to maintain the first and second laterally opposite frame elements 328 and 330 generally coplanar as described above with reference to FIG. 15. As indicated above, the frame 332 may thus be fastened to the toe sole body 318 such that the frame 332 and the toe sole body 318 move together, generally with longitudinal deflection relative to the posterior sole body in substantially similar angles.

Figure 19:
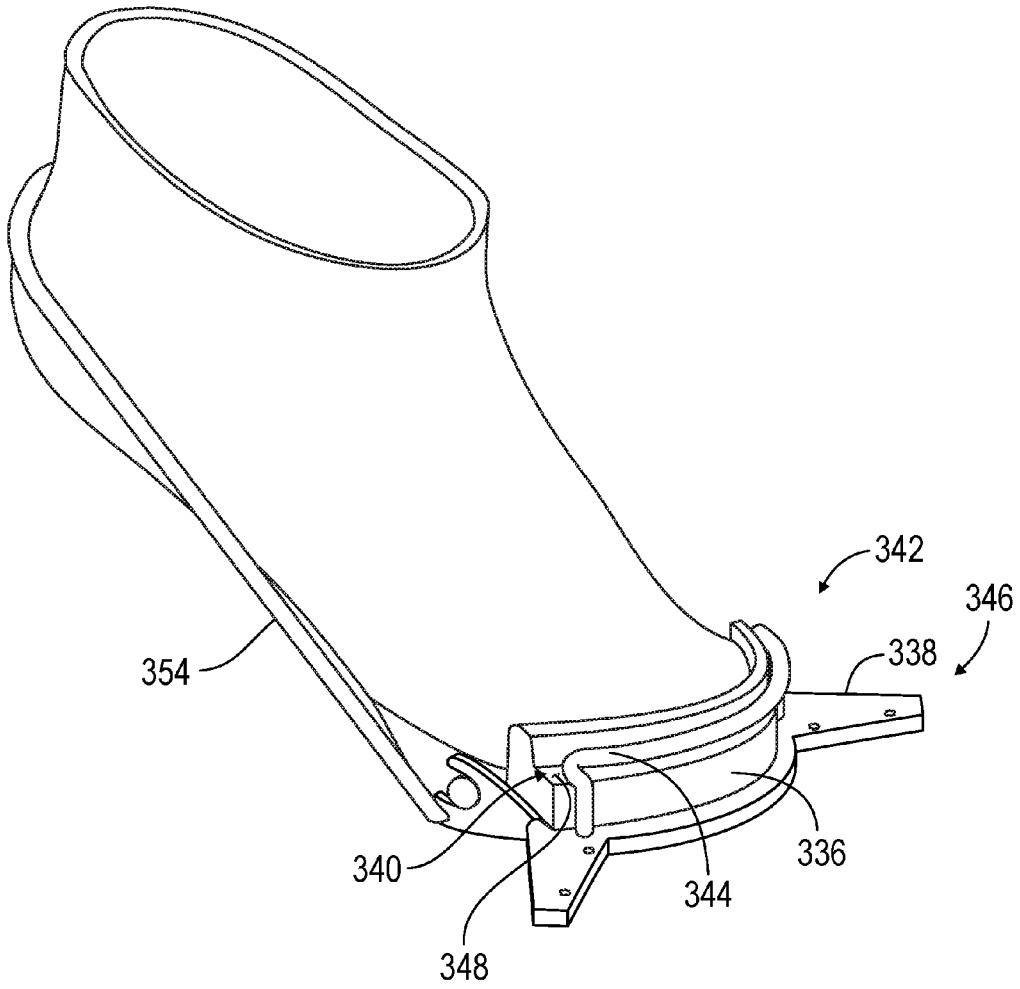
FIG. 19 is a top perspective view of a boot system according to another illustrative embodiment.
Figure 20:
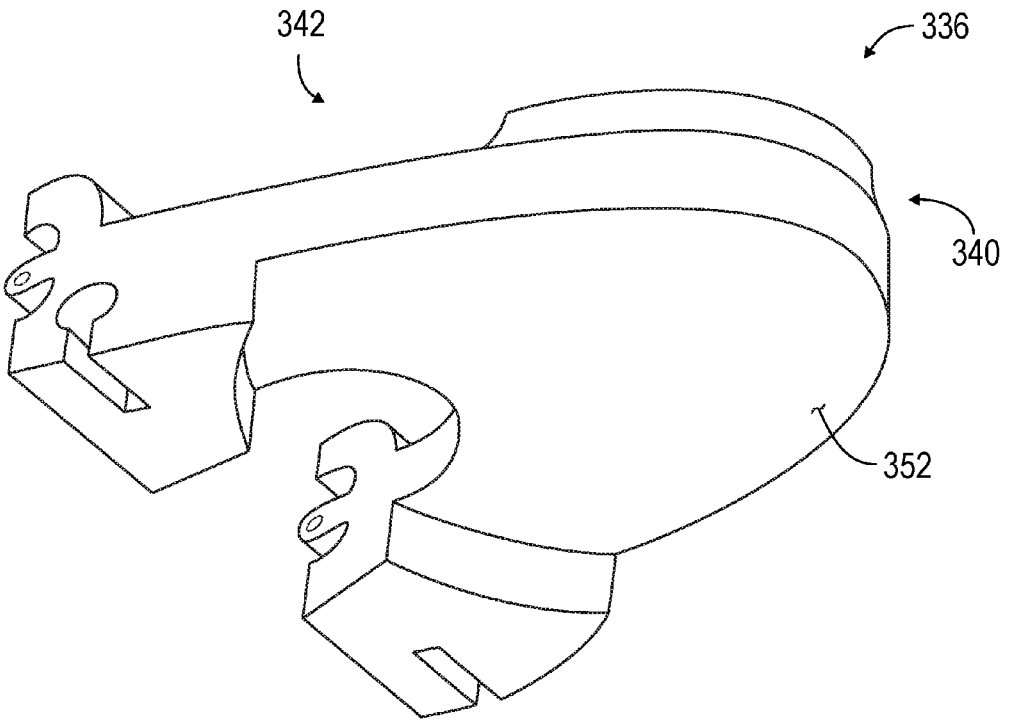
FIG. 20 is a bottom perspective view of a toe sole body of the boot system of FIG. 19.
Figure 21:
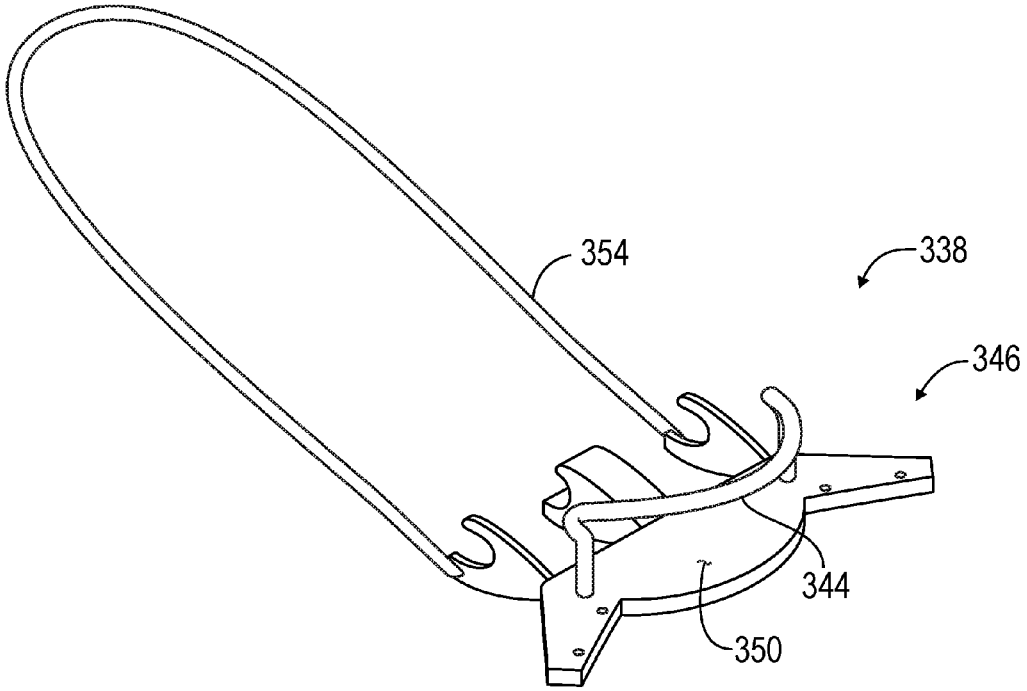
FIG. 21 is a top perspective view of a frame of the boot system of FIG. 19.

Referring to FIG. 19, a boot system according to another illustrative embodiment includes a toe sole body 336 and a frame 338. The toe sole body 336 is substantially the same as the toe sole body 106 described above, but defines a recess shown generally at 340 on a top side shown generally at 342 of the toe sole body 336. Referring to FIGS. 19, 20, and 21, the recess is complementary to a projection 344 on a top side shown generally at 346 of the frame 338. When the projection 344 contacts a surface 348 of the recess 340, the surface 348 holds an upper surface 350 of the frame 338 against a lower surface 352 of the toe sole body 336. A user wearing the boot of FIG. 19 may thus "step in" to the frame 338 and fasten the frame 338, and thus a fin (not shown) connected to the frame 338, to the toe sole body 336 and thus to the boot. The surface 348 of the recess 340 and the lower surface 352 of the toe sole body 336 thus cooperate with the projection 344 and the upper surface 350 of the frame 338 to couple the frame 338 to the toe sole body 336 when the projection 344 is received in the recess 340 as shown in FIG. 19. As indicated above, the frame 338 may thus be fastened to the toe sole body 336 such that the frame 338 and the toe sole body 336 move together, generally with longitudinal deflection relative to the posterior sole body in substantially similar angles. The frame 338 also includes a resilient body 354, which may be used as a heel strap positioned behind a heel end of the boot shown in FIG. 19 to hold the projection 344 in the recess 340 and more generally to hold the frame 338 (and any fin, not shown, that may be attached to the frame 338) in connection with the toe sole body 336 for longitudinal deflection of the frame 338 together with the toe sole body 336 relative to a posterior sole body of the boot system of FIG. 19.

Figure 22:
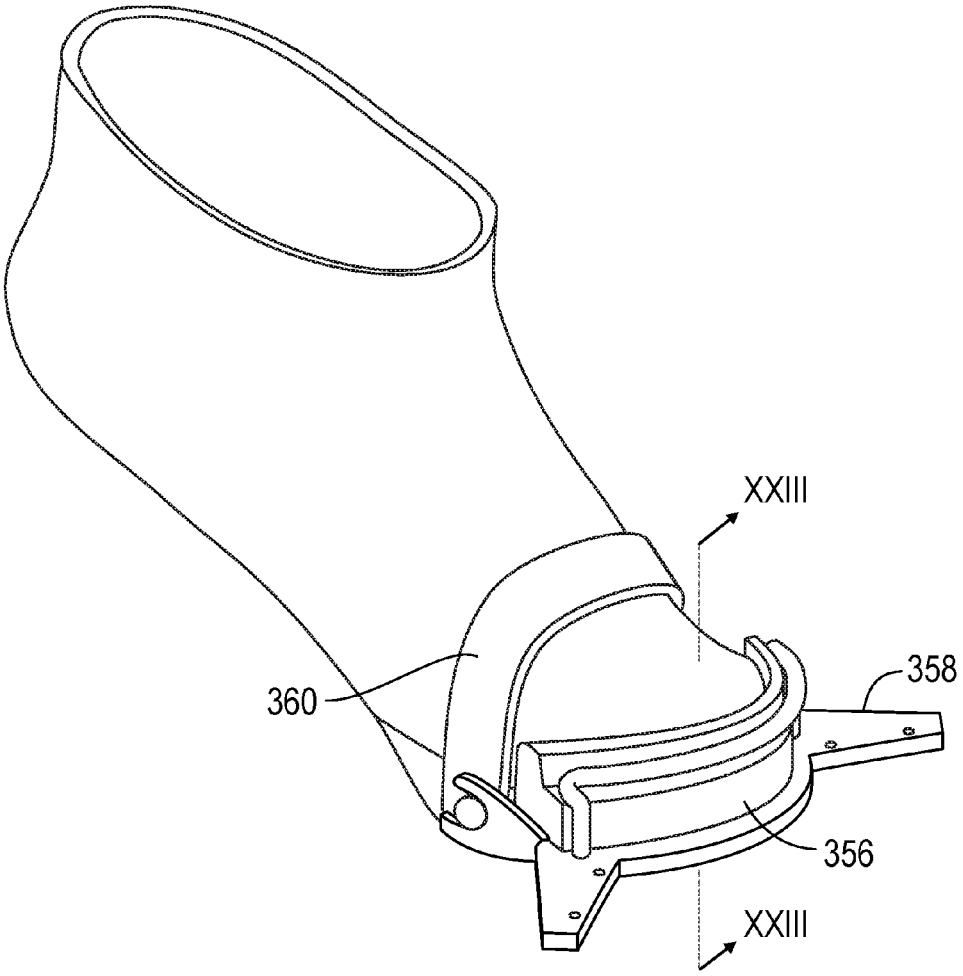
FIG. 22 is a top perspective view of a boot system according to another illustrative embodiment.

Referring to FIG. 22, a boot system according to another illustrative embodiment includes a toe sole body 356 and a frame 358. The toe sole body 356 and the frame 358 are substantially the same as the toe sole body 336 and the frame 338 respectively, except that the frame 358 does not include a heel strap and instead the toe sole body 356 and the frame 358 may be connected and disconnected by actuation of an actuator 360, which in the embodiment shown extends over a top of the boot shown in FIG. 22 when the actuator 360 is in a position (as shown in FIG. 22) in which the frame 358 is connected to the toe sole body 356. The actuator 360 may therefore be referred to as an "instep lever" by reference to the position of the actuator 360 when the frame 358 is connected to the toe sole body 356. The frame 358 may be disconnected from the toe sole body 356 by pivoting the actuator 360 such that the actuator 360 moves away from the boot shown in FIG. 22. Further, a user wearing the boot of FIG. 22 may "step in" to the frame 358 and fasten the frame 358, and thus a fin (not shown) connected to the frame 358, to the toe sole body 356 and thus to the boot.

Figure 23:
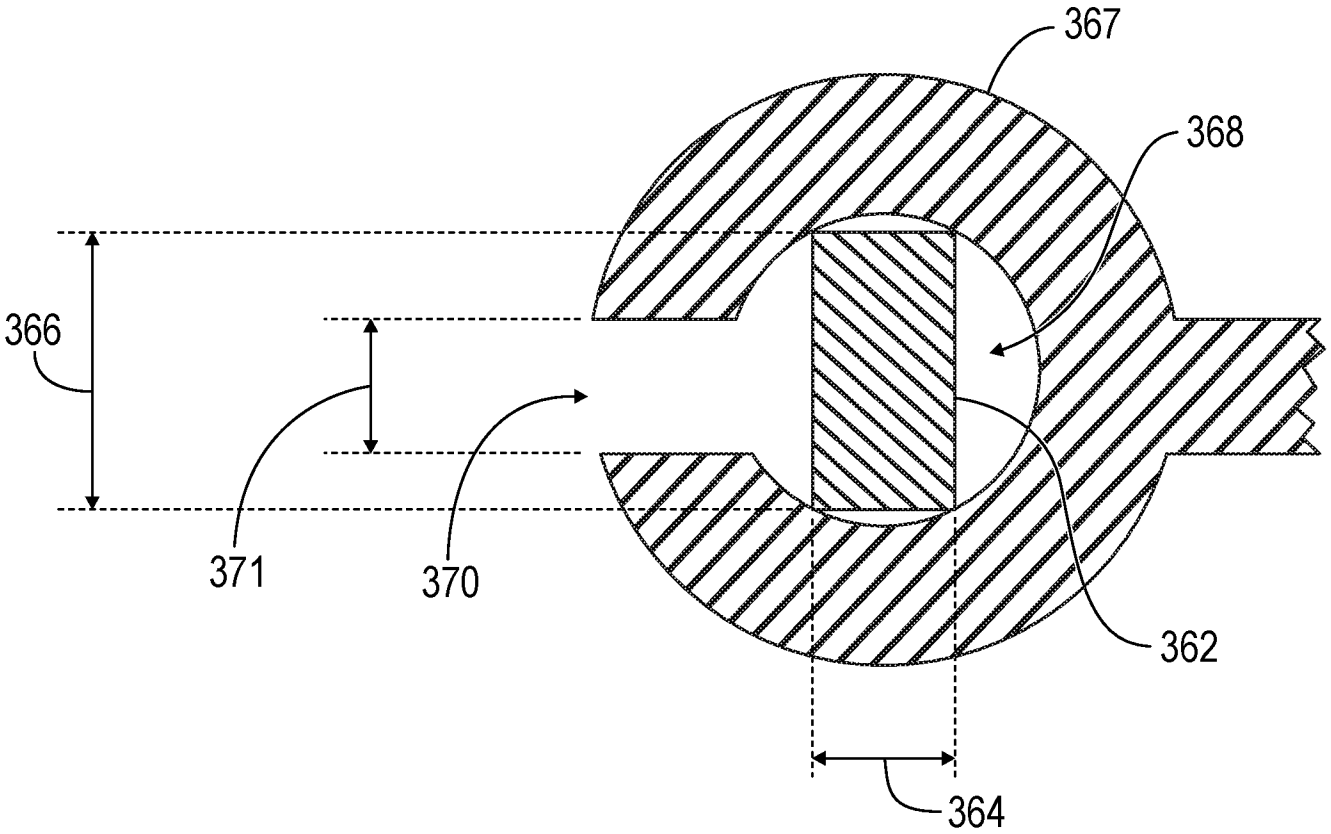
FIG. 23 is a partial cross-sectional view of the boot system of FIG. 22, taken along the line XXIII-XXIII in FIG. 22.

Referring to FIGS. 22 and 23, the actuator 360 is rotationally coupled to a pivot 362, which in the embodiment shown includes a connection region rectangular in cross-section and having a width 364 in a first radial direction and a width 366 in a second radial direction different from (and perpendicular to in the embodiment shown) the first radial direction. The width 366 is greater than the width 364. The frame 358 includes a connector 367 defining a receptacle shown generally at 368 open at an opening shown generally at 370. The opening 370 has a height 371 greater than the width 364 but less than the width 366 such that the opening 370 may receive the connection region of the pivot 362 when the pivot 362 is oriented with the width 364 passing through the opening 370. The pivot 362 may then be rotated (by actuation of the actuator 360) such that the width 366 is blocked from passing through the opening 370, and the connector 367 is thus connected to the connection region of the pivot 362. The pivot 362 may further be rotated (by actuation of the actuator 360) such that the width 364 may pass through the opening 370, and the connector 367 is thus disconnected to the connection region of the pivot 362. Alternative embodiments may include different ways of connecting to a connector such as the connector 367. For example, in an alternative embodiment, actuation of the actuator 360 may translate a pivot in an axial direction relative to the pivot in and out of a receptacle such as the receptacle 368.

Figure 24:
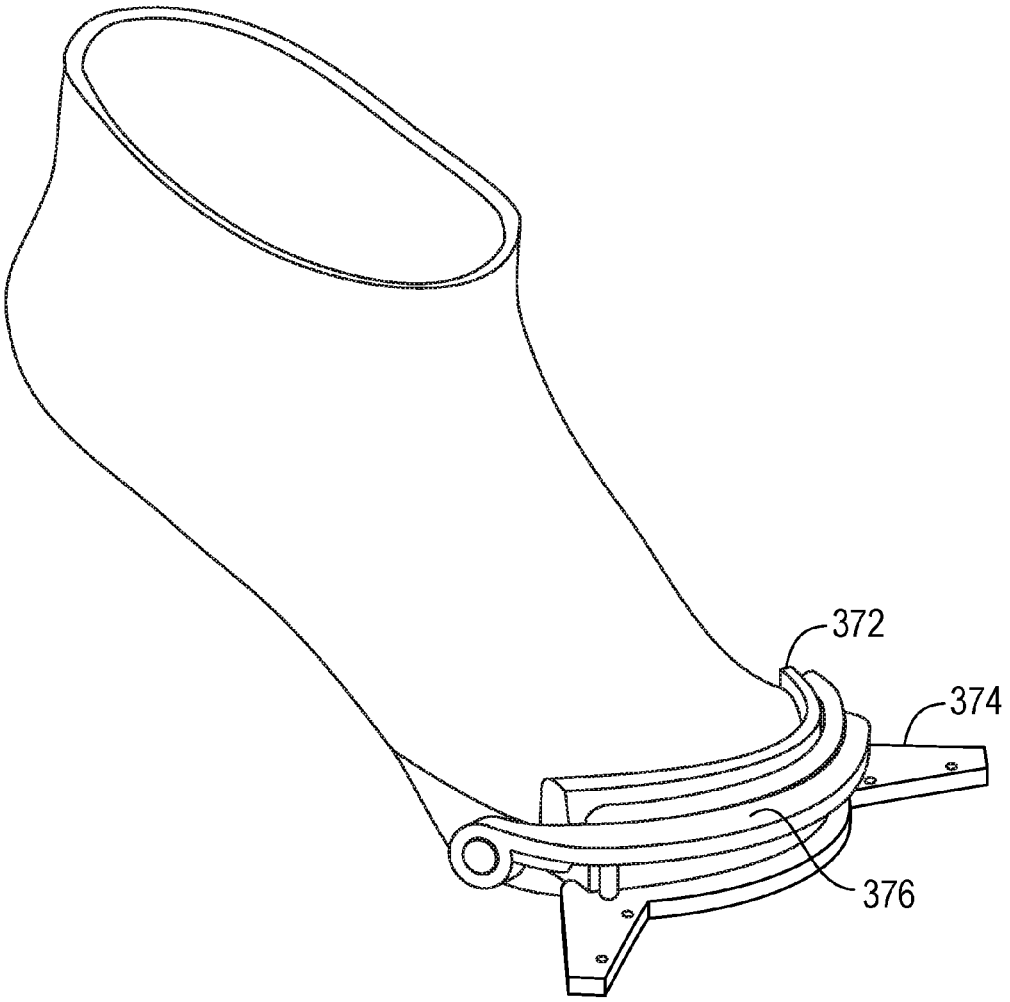
FIG. 24 is a top perspective view of a boot system according to another illustrative embodiment.

Referring to FIG. 24, a boot system according to another illustrative embodiment includes a toe sole body 372 and a frame 374. The toe sole body 372 and the frame 374 are substantially the same as the toe sole body 356 and the frame 358 respectively, except that the actuator 376 of the toe sole body 372 extends over a toe of the boot of FIG. 24 when the actuator 376 is in a position (as shown in FIG. 24) in which the frame 374 is connected to the toe sole body 372. The actuator 376 may therefore be referred to as a "toe lever" by reference to the position of the actuator 376 when the frame 374 is connected to the toe sole body 372. The frame 374 may be disconnected from the toe sole body 372 by pivoting the actuator 376 such that the actuator 376 moves away from the toe region of the boot shown in FIG. 24. Again, a user wearing the boot of FIG. 24 may "step in" to the frame 374 and fasten the frame 374, and thus a fin (not shown) connected to the frame 374, to the toe sole body 372 and thus to the boot.

In general, the sole bodies described herein (such as the posterior sole bodies and the toe sole bodies described herein for example) may be molded into or otherwise formed in boot soles (such as the boot sole 112 shown in FIG. 1 for example) to form integral boot soles connectable to frames that are in turn connectable to fins such as those described herein for example. Such sole bodies may be standardized and manufactured in one or in a small number of sizes, thereby possibly reducing manufacturing costs when compared to other boot binding systems, while boots (such as the boot 102 shown in FIG. 1 for example) may be manufactured by a number of manufactures in a large number of varieties that may vary by foot size and shape, by material, by ankle support, and in many other ways. Further, fins (such as the fin 276 shown in FIG. 12 for example) may also vary in many ways, such as in length, in width, in shape, in material, and in flexibility, for example. Nevertheless, such various boots and various fins may be interchangeable where the boots include standardized sole bodies (such as the posterior sole bodies and the toe sole bodies described herein for example) and where the fins are connectable to standardized frames (such as the frames described herein for example) connectable to such standardized sole bodies. Therefore, a user may interchange a variety of boots and a variety of fins to form combinations of particular boots and particular fins to suit particular purposes (for example, a boot suitable for cold water combined with a fin suitable for spear fishing, or a boot suitable for warm water combined with a fin suitable for snorkeling) without requiring entire flipper apparatuses to embody the desired features of both the boot and the fin.

Although specific embodiments have been described and illustrated, such embodiments should be considered illustrative only and not as limiting the invention as construed according to the accompanying claims.

What is claimed is:

1. A boot sole system for guiding a fin, the system comprising:

at least one toe sole body connectable to the fin and comprising first and second stop surfaces;

a posterior sole body comprising third and fourth stop surfaces; and a transverse hinge for hingedly connecting the at least one toe sole body to the posterior sole body to permit longitudinal deflection of the at least one toe sole body relative to the posterior sole body in a first deflection direction and in a second deflection direction opposite the first deflection direction;

wherein the first, second, third, and fourth stop surfaces are positioned such that when the transverse hinge connects the at least one toe sole body to the posterior sole body:

the first and third stop surfaces abut each other in response to longitudinal deflection of the at least one toe sole body relative to the posterior sole body in the first deflection direction to restrict longitudinal deflection of the at least one toe sole body relative to the posterior sole body in the first deflection direction; and the second and fourth stop surfaces abut each other in response to longitudinal deflection of the at least one toe sole body relative to the posterior sole body in the second deflection direction to restrict longitudinal deflection of the at least one toe sole body relative to the posterior sole body in the second deflection direction.

2. The system of claim 1 wherein the at least one toe sole body comprises a first toe sole body connectable to the fin and to the posterior sole body.

3. The system of claim 2 wherein the first toe sole body comprises first and second laterally opposite frame elements.

4. The system of claim 3 wherein the first and second laterally opposite frame elements are hingedly connectable to respective laterally opposite fin elements.

5. The system of claim 3 wherein the first toe sole body comprises a longitudinal hinge for hingedly connecting the first and second laterally opposite frame elements.

6. The system of claim 2 wherein the transverse hinge comprises a transverse pivot connectable to the posterior sole body.

7. The system of claim 6 wherein the first toe sole body is removably connectable to the posterior sole body at the transverse pivot.

8. The system of claim 7 wherein the first toe sole body comprises a connector defining a receptacle for receiving a portion of the transverse pivot.

9. The system of claim 8 wherein the connector comprises a stop having the first stop surface.

10. The system of claim 6 wherein the transverse pivot is removable from the posterior sole body and from the receptacle.

11. The system of claim 2 wherein the at least one toe sole body comprises a second toe sole body connectable to the posterior sole body at the transverse hinge and connectable to the first toe sole body.

12. The system of claim 11 wherein the second toe sole body defines an opening for receiving a threaded fastener for connecting the second toe sole body to the first toe sole body.

13. The system of claim 11 wherein the second toe sole body defines a recess for receiving a complementary projection on the first toe sole body for connecting the second toe sole body to the first toe sole body.

14. The system of claim 2 wherein the first toe sole body comprises a first at least one resilient body connector for connecting the first toe sole body to a first resilient body for retaining the first toe sole body in connection with the posterior sole body.

15. The system of claim 1 wherein the posterior sole body defines a second at least one resilient body connector for connecting a second resilient body to the posterior sole body, and wherein the at least one toe sole body defines a third at least one resilient body connector for connecting the second resilient body to the at least one toe sole body.

16. The system of claim 15 wherein the second at least one resilient body connector comprises a plurality of longitudinally-spaced-apart resilient body connectors.

17. The system of claim 1 further comprising the fin.

18. The system of claim 1 wherein the transverse hinge comprises a transverse pivot connectable to the posterior sole body.

19. A boot comprising a boot sole system for guiding a fin, the system comprising:

at least one toe sole body connectable to the fin and comprising first and second stop surfaces;

a posterior sole body comprising third and fourth stop surfaces; and a transverse hinge for hingedly connecting the at least one toe sole body to the posterior sole body to permit longitudinal deflection of the at least one toe sole body relative to the posterior sole body in a first deflection direction and in a second deflection direction opposite the first deflection direction;

wherein the first, second, third, and fourth stop surfaces are positioned such that when the transverse hinge connects the at least one toe sole body to the posterior sole body:

the first and third stop surfaces abut each other in response to longitudinal deflection of the at least one toe sole body relative to the posterior sole body in the first deflection direction to restrict longitudinal deflection of the at least one toe sole body relative to the posterior sole body in the first deflection direction; and the second and fourth stop surfaces abut each other in response to longitudinal deflection of the at least one toe sole body relative to the posterior sole body in the second deflection direction to restrict longitudinal deflection of the at least one toe sole body relative to the posterior sole body in the second deflection direction.

20. The boot of claim 19 wherein the transverse hinge extends proximate a region in the boot for metatarsophalangeal joints of a user wearing the boot.

21. A fin comprising a toe sole body hingedly connectable to a posterior sole body of a boot, wherein the toe sole body comprises first and second stop surfaces, and wherein:

the first stop surface is positioned to abut a third stop surface on the posterior sole body in response to longitudinal deflection of the toe sole body relative to the posterior sole body in a first deflection direction, when the toe sole body is connected to the posterior sole body, to restrict longitudinal deflection of the toe sole body relative to the posterior sole body in the first deflection direction; and the second stop surface is positioned to abut a fourth stop surface on the posterior sole body in response to longitudinal deflection of the toe sole body relative to the posterior sole body in a second deflection direction opposite the first deflection direction, when the toe sole body is connected to the posterior sole body, to restrict longitudinal deflection of the toe sole body relative to the posterior sole body in the second deflection direction.

22. The fin of claim 21 wherein the toe sole body comprises first and second laterally opposite frame elements.

23. The fin of claim 22 wherein the first and second laterally opposite frame elements are hingedly connectable to respective laterally opposite fin elements.

24. The fin of claim 22 wherein the toe sole body comprises a longitudinal hinge for hingedly connecting the first and second laterally opposite frame elements.

25. The fin of claim 21 wherein the toe sole body comprises a connector defining a receptacle for receiving a portion of a transverse pivot connectable to the posterior sole body.

26. The fin of claim 25 wherein the connector comprises a stop having the first stop surface.

* * * * *